US007110711B2

(12) United States Patent
Tomatsu

(10) Patent No.: US 7,110,711 B2
(45) Date of Patent: Sep. 19, 2006

(54) THERMAL FIXING DEVICE AND IMAGE FORMING APPARATUS

(75) Inventor: Yoshiya Tomatsu, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 157 days.

(21) Appl. No.: 10/773,212

(22) Filed: Feb. 9, 2004

(65) Prior Publication Data

US 2004/0228665 A1 Nov. 18, 2004

(30) Foreign Application Priority Data

Feb. 10, 2003 (JP) ..... 2003-032180

(51) Int. Cl.
*G03G 15/20* (2006.01)
*G03G 15/00* (2006.01)

(52) U.S. Cl. ..... 399/322; 399/406

(58) Field of Classification Search ..... 399/320–323, 399/328–334, 406
See application file for complete search history.

(56) References Cited

U.S. PATENT DOCUMENTS 4,580,033 A * 4/1986 Sakurai ..... 219/216
5,258,815 A * 11/1993 Nakagawa et al. ..... 399/406
5,893,019 A * 4/1999 Yoda et al. ..... 399/321
6,002,913 A * 12/1999 Pawlik et al. ..... 399/406
6,298,214 B1 10/2001 Koga

FOREIGN PATENT DOCUMENTS

JP 05273881 A * 10/1993
JP Y2 2512664 7/1996
JP A 8-314317 11/1996
JP A 2000-352887 12/2000

* cited by examiner

*Primary Examiner*—David M. Gray
*Assistant Examiner*—Ryan Gleitz
(74) *Attorney, Agent, or Firm*—Oliff & Berridge, PLC

(57) ABSTRACT

At a conveyance direction downstream side of a contact portion between a heat roller and a downstream side pressure roller and at a conveyance direction upstream side of a contact portion (conveyance position) between a conveyance roller and an upstream side pinch roller in a conveyance mechanism part, the conveyance roller is disposed to come in contact with a surface of a sheet opposite to a surface having come in contact with the heat roller. Besides, a first guide member for guiding the sheet to the conveyance position of the conveyance mechanism part is disposed to face the conveyance roller.

97 Claims, 9 Drawing Sheets

THERMAL FIXING DEVICE AND IMAGE FORMING APPARATUS

BACKGROUND OF THE INVENTION

1. Field of the Invention

The present invention relates to a thermal fixing device and an image forming apparatus including the thermal fixing device.

2. Description of the Related Art

An image forming apparatus such as a laser printer is generally provided with a thermal fixing device for thermally fixing a toner transferred on a sheet.

Such a thermal fixing device includes a heat roller, a pressure roller disposed to face the heat roller and for pressing a sheet to the heat roller, and a pair of conveyance rollers disposed to face each other at a conveyance direction downstream side of the sheet with respect to the heat roller and the pressure roller and for conveying the thermally fixed sheet.

The sheet on which a toner is transferred enters between the heat roller and the pressure roller so that the toner on the sheet comes in contact with the heat roller, and the sheet is heated under pressure between the heat roller and the pressure roller so that the toner on the sheet is melted and thermally fixed, and then, the sheet enters between the pair of transfer rollers and is ejected while being held between the conveyance rollers.

However, in the thermal fixing device as stated above, since the sheet is heated under pressure between the heat roller and the pressure roller, the sheet having passed through between the heat roller and the pressure roller becomes apt to get a curl having the same shape as the circumferential shape of the heat roller. Then, a jam occurs when the sheet having the curl enters between the pair of conveyance rollers.

In order to overcome the above problem, there is proposed a technique that a guide member for guiding a sheet or the like sent out by a fixing rotation body toward a direction in which an upward curl is not cancelled out is provided between the fixing rotation body and a paper ejecting rotation body pair, the front end of the sheet or the like separated from the guide member is hung down by its own weight so that it is curved in the opposite direction to the direction of the curl, and the front end of the sheet or the like curled upward is guided to a nip part of the paper ejecting rotation body pair (see Japanese Utility Model Registration No. 2512664).

SUMMARY OF THE INVENTION

However, in the above described conventional technique, since the guide member is merely formed in a shape bent toward the opposite side to the direction of the curl of the front end of the sheet having passed through the fixing rotation body, when the curl of the front end of the sheet or the like is large, there is a disadvantage that even if the sheet or the like comes in contact with the guide member, it is not guided to the nip part of the paper ejecting rotation body pair, and a jam occurs.

It is therefore an object of the invention is to provide a thermal fixing device that assuredly guides a fixation medium having passed through between a fixing member and a pressuring member to a conveyance position of a conveying unit and can reduce the occurrence of a jam, and an image forming apparatus including the thermal fixing device.

In order to achieve the object, according to a first aspect of the invention, there is provided a thermal fixing device including: a fixing member disposed to be in contact with a fixation medium; a pressuring member disposed to face the fixing member and configured to press the fixation medium against the fixing member; a conveying unit configured to convey the fixation medium that has passed through between the fixing member and the pressuring member; a conveyance member configured to convey the fixation medium, and configured to be in contact with the fixation medium on a surface that is opposite to a surface where the fixing member contacts with at a position that is downstream of the fixing member with respect to a conveyance direction of the fixation medium and is upstream of a conveyance position where the conveyance unit conveys the fixation medium; and a guide member disposed to face the conveyance member and configured to guide the fixation medium to the conveyance position.

According to a second aspect of the invention, there is provided an image forming apparatus including: a sheet feeding section configured to feed a sheet; and an image forming section configured to form an image on the sheet fed by the sheet feeding section, wherein the image forming section includes a thermal fixing device including: a fixing member disposed to be in contact with the sheet; a pressuring member disposed to face the fixing member and configured to press the sheet against the fixing member; a conveying unit configured to convey the sheet that has passed through between the fixing member and the pressuring member; a conveyance member configured to convey the sheet, and configured to be in contact with the sheet on a surface that is opposite to a surface where the fixing member contacts with at a position that is downstream of the fixing member with respect to a conveyance direction of the sheet and is upstream of a conveyance position where the conveyance unit conveys the sheet; and a guide member disposed to face the conveyance member and configured to guide the sheet to the conveyance position.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Referring now to the accompanying drawings, a description will be given in detail of a preferred embodiment of the invention.

Figure 1:
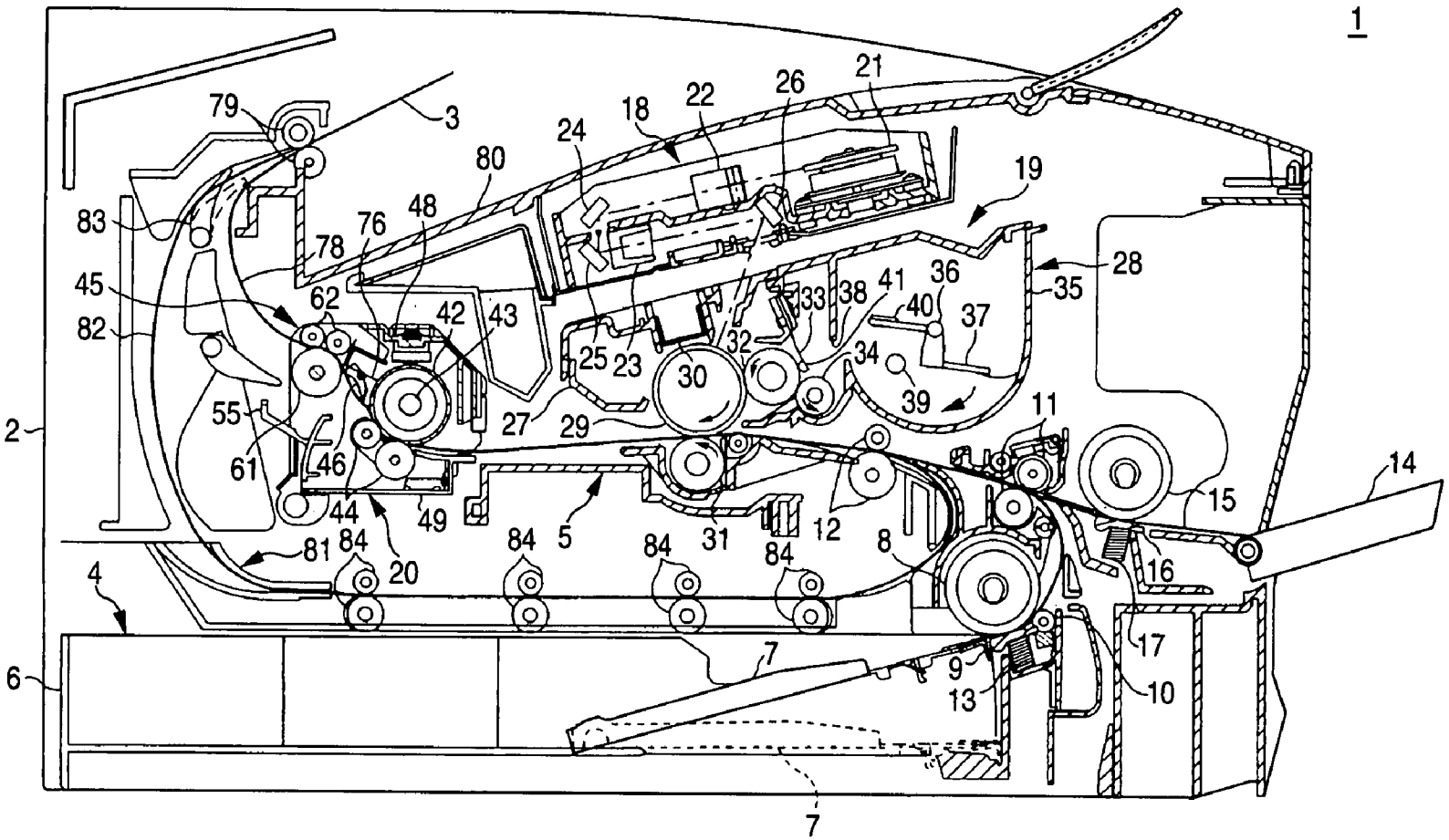
FIG. 1 is a main part sectional side view showing an embodiment of a laser printer as an image forming apparatus according to the invention.

FIG. 1 is a main part side sectional view showing the preferred embodiment of a laser printer as an image forming apparatus according to the invention. As shown in FIG. 1, a laser printer 1 includes a sheet feeding section 4 for feeding a sheet 3 as a fixation medium, an image forming section 5 for forming an image on the fed sheet 3, and other components in a main body casing 2.

The sheet feeding section 4 includes a sheet feed tray 6, a sheet press plate 7 provided in the sheet feed tray, a sheet feed roller 8 and a sheet feed pat 9 provided above one end of the sheet feed tray 6, paper dust removal rollers 10 and 11 provided at a conveyance direction downstream side of the sheet 3 (hereinafter, the conveyance direction downstream side of the sheet 3 is simply referred to as "conveyance direction downstream side", and the conveyance direction upstream side of the sheet 3 is simply referred to as "conveyance direction upstream side", and a description will be made) with respect to the sheet feed roller 8, and a registration roller 12 provided at the conveyance direction downstream side with respect to the paper dust removal rollers 10 and 11.

The sheet press plate 7 can be stacked with the sheets 3 in a laminate state, and is swingably supported at a farther end with respect to the sheet feed roller 8 so that a nearer end can be moved vertically, and is urged upward by a not-shown spring from its back side. Thus, as the amount of lamination of the sheets 3 is increased, the sheet press plate 7 is swung downward against the urging force of the spring, while the farther end with respect to the sheet feed roller 8 is made a fulcrum. The sheet roller 8 and the sheet pat 9 are disposed to face each other, and the sheet feed pat 9 is pressed to the sheet feed roller 8 by a spring 13 provided at the back side of the paper sheet pat 9.

The uppermost sheet 3 on the sheet press plate 7 is pressed against the sheet roller 8 from the back side of the sheet press plate 7 by a not-shown spring, and after the sheet is held between the sheet feed roller 8 and the sheet feed pat 9, the sheet feed roller 8 is rotated, so that the sheet is fed one by one. In the laser printer 1, after paper dust of the fed sheet 3 is removed by the paper dust removal rollers 10 and 11, the sheet is fed to the registration roller 12.

The registration roller 12 is constructed by a pair of rollers, and sends the sheet 3 to an image formation position after registration. Incidentally, the image formation position is a transfer position where a toner image on a photosensitive drum 29 is transferred to the sheet 3, and is, in the embodiment, a contact position between the photosensitive drum 29 and the transfer roller 31.

Besides, the sheet feeding section 4 includes a multipurpose tray 14, a multipurpose side sheet feed roller 15 for feeding the sheet 3 stacked on the multipurpose tray 14 and a multipurpose side sheet feed pat 16. The multipurpose side sheet feed roller 15 and the multipurpose side sheet feed pat 16 are disposed to face each other, and the multipurpose side sheet feed pat 16 is pressed to the multipurpose side sheet feed roller 15 by a spring 17 provided at the back side of the multipurpose side sheet feed pat 16. The sheet 3 stacked on the multipurpose tray 14 is held between the multipurpose side sheet feed roller 15 and the multipurpose side sheet feed pat 16 by the rotation of the multipurpose side sheet feed roller 15, and then, it is fed one by one. The fed sheet 3 is sent to the registration roller 12 after its paper dust is removed by the paper dust removal roller 11.

The image formation part 5 includes a scanner section 18, a process section 19, a fixing section 20 as a thermal fixing device, and other components.

The scanner section 18 is provided at an upper part in the main body casing 2, and includes a laser emission unit (not shown), a polygon mirror 21 driven to be rotated, lenses 22 and 23, reflecting mirrors 24, 25 and 26. A laser beam emitted from the laser emission unit and based on image data passes through or is reflected by the polygon mirror 21, the lens 22, the reflecting mirrors 24 and 25, the lens 23 and the reflecting mirror 26 in sequence as indicated by a chain line, and is irradiated on the surface of the photosensitive drum 29 of the process section 19 by high speed scanning.

The process section 19 is disposed below the scanner section 18, and includes, in a drum cartridge 27 detachably mounted to the main body casing 2, a development cartridge 28, the photosensitive drum 29, a Scorotron type charging unit 30, and the transfer roller 31.

The development cartridge 28 is detachably mounted to the drum cartridge 27, and includes a developing roller 32, a layer thickness regulating blade 33, a supply roller 34, and a toner hopper 35.

The toner hopper 35 is filled with, as a developing agent, a positive charging nonmagnetic one-component toner. As the toner, a polymerized toner is used which is obtained by copolymerizing a polymerizable monomer, for example, styrene monomer such as styrene, or acrylic monomer such as acrylic acid, alkyl (C1 to C4) acrylate, or alkyl (C1 to C4) metaacrylate by a well-known polymerization method such as suspension polymerization. The polymerized toner as stated above has roughly a spherical shape, its fluidity is very excellent, and high quality image formation can be achieved.

Incidentally, the toner as stated above is mixed with wax or a coloring agent such as carbon black, and is added with an additive such as silica in order to improve the fluidity. Particle diameter of the additive is about 6 μm to 10 μm.

The toner in the toner hopper 35 is agitated in a direction shown by an arrow in FIG. 1 (clockwise direction) by an agitator 37 supported by a rotation shaft 36 provided at the center of the toner hopper 35, and is discharged through a toner supply port 38 opening to the supply roller 34 from the toner hopper 35. Incidentally, both side walls of the toner hopper 35 are provided with windows 39 for detection of the residual amount of toner, and the residual amount of toner in the toner hopper 35 can be detected. The window 39 is cleaned by a cleaner 40 supported by the rotation shaft 36.

The supply roller 34 is rotatably disposed at a facing position of the opposite side to the toner hopper 35 with respect to the toner support port 38, and the developer roller 32 is rotatably disposed to face the supply roller 34. The supply roller 34 and the developer roller 32 are in contact with each other in such a state that they are respectively compressed in some degree.

The supply roller 34 is such that a roller made of conductive foam material covers a roller shaft made of metal, and is driven to be rotated in a direction shown by an arrow direction in FIG. 1 (counterclockwise direction) by a not-shown motor.

The developer roller 32 is a roller made of conductive rubber material covers a roller shaft made of metal. More specifically, the roller of the developing roller 32 is such that the surface of a roller main body made of conductive urethane rubber or silicone rubber containing carbon fine particles or the like is covered with a coat layer of urethane rubber or silicone rubber containing fluorine. Incidentally, at the time of development, a development bias is applied to the developing roller 32 from a not-shown power source, and the roller is driven to be rotated in a direction shown by an arrow in FIG. 1 (counterclockwise direction) by a not-shown motor.

The layer thickness regulating blade 33 is disposed in the vicinity of the developing roller 32. The layer thickness regulating blade 33 includes a press part 41 made of insulating silicone rubber and having a semicircular section at a tip part of a blade main body made of a metal plate spring member, and is supported by the development cartridge 28 in the vicinity of the developing roller 32, and the press part 41 is provided so as to be pressed onto the developing roller 32 by the elastic force of the blade main body.

The toner discharged from the toner supply port 38 is supplied to the developing roller 32 by the rotation of the supply roller 34, and is positively charged at the time by the friction between the supply roller 34 and the developing roller 32, and further, the toner supplied onto the developing roller 32 enters a space between the press part 41 of the layer thickness regulating blade 33 and the developing roller 32 in accordance with the rotation of the developing roller 32, and is supported as a thin layer having a specified thickness on the developing roller 32.

The photosensitive drum 29 is rotatably supported at a facing position of an opposite side of the supply roller 34 with respect to the developing roller 32 and in the drum cartridge 27. The photosensitive drum 29 includes a grounded dram main body, its surface is formed of a positively-charged photosensitive layer made of material such as polycarbonate, and the photosensitive drum is driven to be rotated in a direction shown by an arrow in FIG. 1 (clockwise direction) by a not-shown motor.

The Scorotron type charging unit 30 is disposed above and facing to the photosensitive drum 29. The Scorotrom type charging unit 30 is disposed away from the photosensitive drum 29 by a specified distance so as not to come in contact therewith. The Scorotron type charging unit 30 is configured to be charged positive and to generate corona discharge from a charging wire made of material such as tungsten. The Scorotron type chaging unit 30 is provided to uniformly and positively charge the surface of the photosensitive drum 29 by application of voltage from a not-shown power source.

The transfer roller 31 is disposed below the photosensitive drum 29 to face the photosensitive drum 29, and is rotatably supported by the drum cartridge 27. The transfer roller 31 is a roller made of conductive rubber material covers a roller shaft made of metal, and at the time of transfer, a transfer bias is applied from a not-shown power source, and the transfer roller is driven to be rotated in a direction shown by an arrow in FIG. 1 (counterclockwise direction) by a not-shown motor.

The surface of the photosensitive drum 29 is charged uniformly and positively by the Scorotron type charging unit 30, and then, an electrostatic latent image is formed by a laser beam irradiated by the scanner section 18, and then, when the photosensitive drum faces the developing roller 32, and when the toner supported on the developing roller 32 and positively charged faces and comes in contact with the photosensitive drum 29 by the rotation of the developing roller 32, the toner is supplied to the electrostatic latent image formed on the surface of the photosensitive drum 29, that is, to the exposed portion of the uniformly positively charged photosensitive drum 29, which is exposed by the laser beam and whose potential is lowered, and the toner is selectively supported, so that the toner image is formed, whereby a reversal development is achieved.

Thereafter, the toner image supported on the surface of the photosensitive drum 29 is transferred to the sheet 3 by a transfer bias applied to the transfer roller 31 while the sheet 3 passes through between the photosensitive drum 29 and the transfer roller 31.

Figure 2:
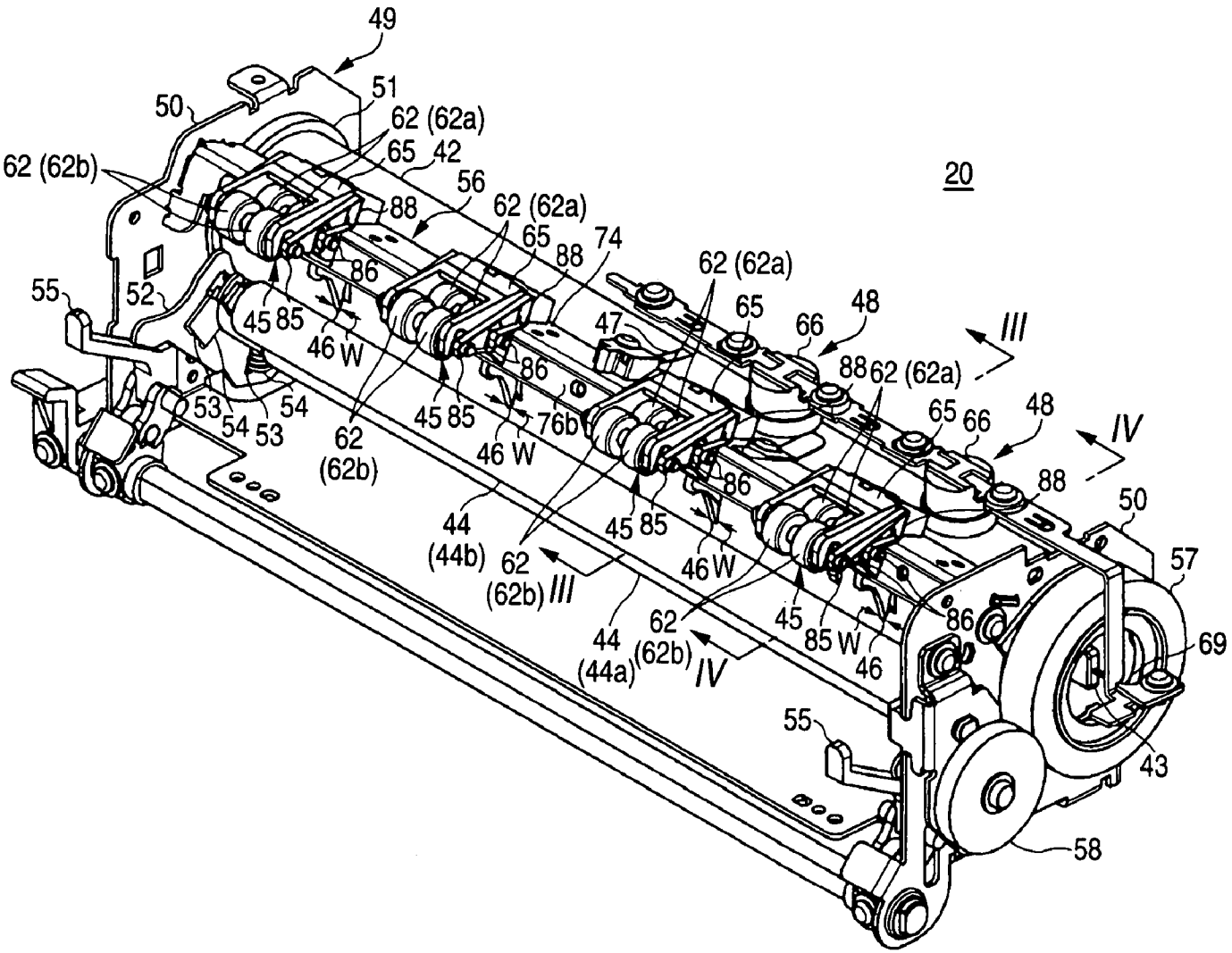
FIG. 2 is a main part perspective view of a fixing section of the laser printer.
Figure 3:
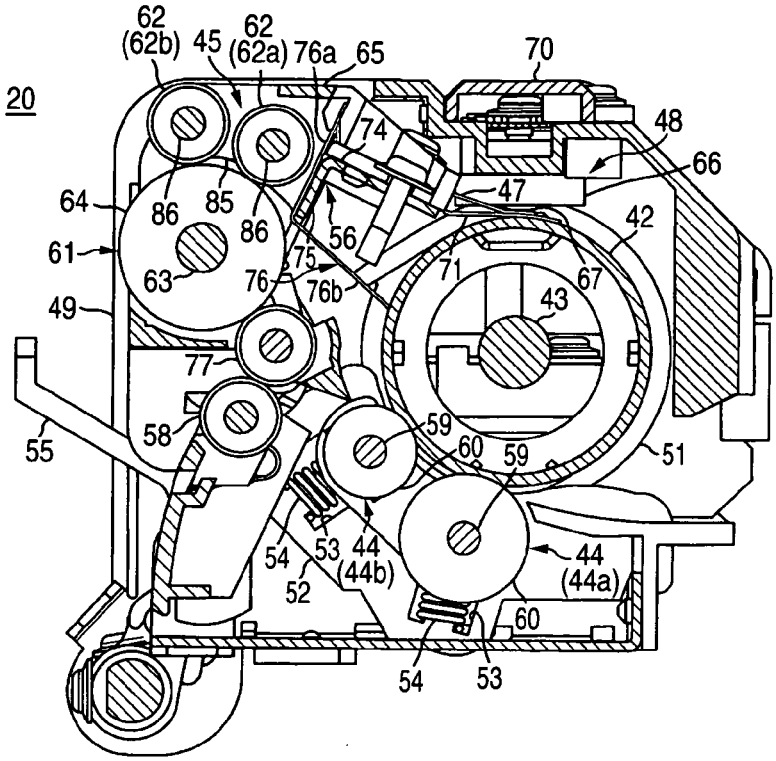
FIG. 3 is a sectional view taken along line III—III shown in FIG. 2.

The fixing section 20 is disposed at the conveyance direction downstream side with respect to the process section 19, and includes, as shown in FIGS. 2 and 3, a heat roller 42 as a fixing member and a fixing roller, a fixation heater 43 as a heating unit, two pressure rollers 44 as pressuring members, a conveyance mechanism section 45 as a conveying unit, four peeling pawls 46 (see FIG. 8) as peeling members, a thermistor 47, and two thermostats 48, and these are supported by a fixation frame 49.

As shown in FIG. 2, the fixation frame 49 includes a pair of support plates 50 holding the heat roller 42 in an axial direction and facing each other, and bearing members 51 for rotatably supporting the heat roller 42 are provided at the respective support plates 50. Each of the bearing members 51 is formed into a ring shape having an inner diameter corresponding to an outer diameter of the heat roller 42 so that the outer peripheral surface of the heat roller 42 can be rotatably received. Each of the bearing members 51 is formed of material (for example, polyphenylene sulfide: melting point of 280° C.) which is softened when the temperature exceeds the thermal fixation temperature (for example, 220° C.) at which the toner image transferred on the sheet 3 is thermally fixed.

An pressure roller support plates 52 for supporting the plural pressure rollers 44 are provided on the respective support plates 50. Pressure roller attachment grooves 53 corresponding to the respective pressure rollers 44 are respectively formed in the respective pressure roller support plates 52. Springs 54 are respectively provided in the respective pressure roller attachment grooves 53. One end of each of the springs 54 is fixed to the pressure roller attachment groove 53, and the other end is attached to a roller shaft 59 of the pressure roller 44.

The respective pressure roller support plates 52 are swingably provided to the respective support plates 50, press levers 55 swingably supported to the respective support plates 50 engage with the pressure roller support plates 52, and the respective press levers 55 are swung so that the respective pressure roller support plates 52 are swung.

According to the above, press contact and its release of the respective pressure rollers 44 to the heat rollers 42 are performed.

The fixation frame 49 includes an erection frame 56 provided between the respective support plates 50.

As shown in FIG. 3, the erection frame 56 is disposed between the heat roller 42 and an after-mentioned conveyance roller 61 in the conveyance direction of the sheet 3, and has a substantially L-letter shaped section in which a horizontal cover 74 and a vertical cover plate 75 formed to be bent substantially perpendicularly to the horizontal cover plate 74 are integrally formed. In a state where a free end part of the horizontal cover plate 74 faces an upper part of the heat roller 42, and a free end of the vertical cover plate 75 faces a side of the conveyance roller 61 at the conveyance direction upstream side, as shown in FIG. 2, the erection frame is supported between the respective support plates 50 so that its longitudinal direction becomes parallel to the axial direction of the heat roller 42.

The erection frame 56 is provided with a first guide member 76 as a guide member. The first guide member 76 is made of a steel plate of metal extending along the axial direction of the heat roller 42, has a flat plate shape of a substantially L-letter shaped section in which a support piece 76*a* and a guide piece 76*b* are integrally formed, and is disposed between the heat roller 42 and the conveyance roller 61. The first guide member 76 is disposed so that the support piece 76*a* is coupled to the vertical cover plate 75, the conveyance direction upstream side free end of the guide piece 76*b* faces the surface of the heat roller 42, and the conveyance direction downstream side base part thereof (continuous portion to the support piece 76*a*) faces the surface of the conveyance roller 61.

Figure 7:
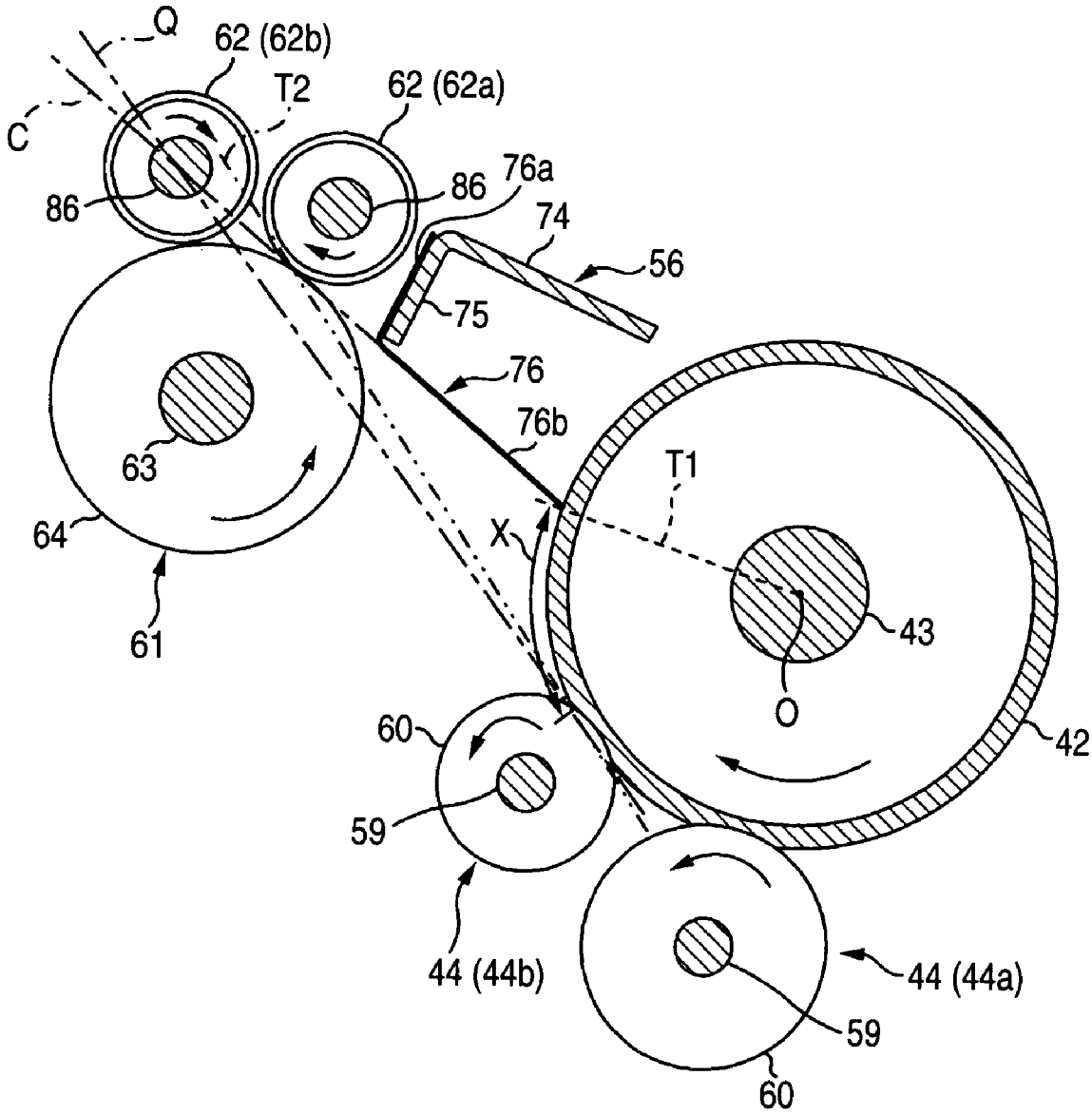
FIG. 7 is an enlarged sectional view of the fixing section shown in FIG. 3.

More specifically, as shown in FIG. 7, the guide piece 76*b* of the first guide member 76 is disposed along a direction in which a line C intersecting with a tangential line Q of a contact portion between the heat roller 42 and the downstream side pressure roller 44*b* (more specifically, a substantially center portion of the contact portion in the rotation direction of the heat roller 42, and the same shall apply hereinafter unless mentioned otherwise) extends.

The guide piece 76*b* of the first guide member 76 is set so that a distance X in a circumferential direction along the surface of the heat roller 42 from the most downstream portion of the contact portion between the heat roller 42 and the downstream side pressure roller 44*b* in the rotation direction of the heat roller 42 is 5 mm or more in the downstream side in the rotation direction of the heat roller 42, and is provided to be inclined in such a direction that an end of the guide piece 76*b* at the conveyance direction downstream side is separated from the conveyance roller 61 with respect to a line T1 passing through an end of the guide piece 76*b* at the conveyance direction upstream side from the rotation center O of the heat roller 42.

Although the first guide member 76 is provided in the facing state along the axial direction of the heat roller 42, at positions where the respective peeling pawls 46, which will be described later, are provided, not-shown openings are formed in the guide piece 76*b* in order to expose the respective peeling pawls 46.

The erection frame 56 is provided with, as shown in FIG. 2, a pinch roller support part 65 for supporting an after-mentioned pinch roller 62 of the conveyance mechanism section 45. Plural, four in the embodiment, such pinch roller support parts 65 are provided along the axial direction of the heat roller 42 at specified distances.

Figure 8:
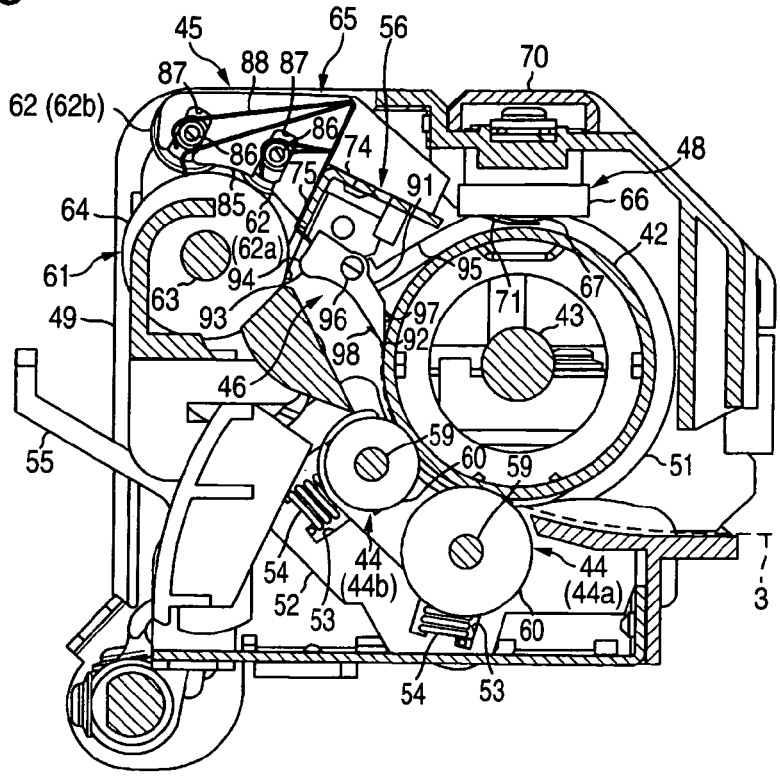
FIG. 8 is a sectional view (a state in which the front end of the sheet passes through between a heat roller and respective pressure rollers, and a peeling pawl is in contact with the heat roller) taken along line IV—IV shown in FIG. 2.

Each of the pinch roller support parts 65 is formed to be substantially C-letter shaped when viewed on a plane, and includes second guide members 85 made of resin and disposed to face each other while being disposed away from each other by a specified distance. Each of the second guide members 85 is formed to protrude like a plate toward the conveyance direction downstream side from the vertical cover plate 75 of the erection frame 56, and is formed, as shown in FIG. 8, to have a curved shape along the surface of the conveyance roller 61 at a position above the conveyance roller 61. More specifically, each of the second guide members 85 is formed to have a substantially arc shape such that its end at the conveyance direction upstream side faces the side of the conveyance roller 61 at the conveyance direction upstream side, its end at the conveyance direction downstream side faces the upper part of the conveyance roller 61, and a portion between the end at the conveyance direction upstream side and the end at the conveyance direction downstream side faces the conveyance roller 61 while being disposed away therefrom by a specified distance.

In each of the second guide members 85, two support grooves 87 for receiving a support shaft 86 for supporting the pinch roller 62, which will be described later, are formed to have a substantially U-letter shaped form opening to the lower part when viewed laterally while being disposed away from each other along the conveyance direction of the sheet 3 by a specified distance.

In the fixation frame 49, as shown in FIG. 2, the one support plate 50 is provided with a heat roller drive gear 57 for externally mating with the bearing member 51, and an input gear 58 which is disposed at the side of the heat roller drive gear 57 to engage with the heat roller drive gear 57 and to which power from a not-shown motor is inputted. Incidentally, a transmission gear 77 (see FIG. 3) engaging with the input gear 58 and a not-shown conveyance roller drive gear provided at a roller shaft 63 of the conveyance roller 61 is provided at a position where overlaps with the input gear 58 in the axial direction of the heat roller 42.

The heat roller 42 is formed into a cylinder shape by draw molding of metal such as aluminum, and both ends in the axial direction are press inserted in the respective bearing members 51. When power is inputted from a not-shown motor through the input gear 58 and the heat roller drive gear. 57, the heat roller 42 is rotated in a direction shown by an arrow shown in FIG. 7 (clockwise direction).

The fixation heater 43 in which made of a halogen heater or the like for generating heat by energization, is disposed at the axial core in the heat roller 42, and is provided along the axial direction of the heat roller 42 in order to heat the heat roller 42. The fixation heater 43 is controlled to be ON or OFF by a not-shown CPU at the time of fixation, and the surface of the heat roller 42 is kept at a set thermal fixation temperature. Incidentally, a wiring 69 to which power is applied from a not-shown power source is connected to the fixation heater 43.

As shown in FIG. 3, the plurality of pressure rollers 44 (two in the embodiment) are provided below the heat roller 42 so as to face the heat roller 42 along the conveyance direction of the sheet 3. Each of the pressure rollers 44 is such that a roller 60 made of heat resistant rubber material covers the roller shaft 59 made of metal, and as shown in FIG. 2, respective shaft ends of the roller shaft 59 are inserted in the pressure roller attachment grooves 53 of the respective pressure roller support plates 52, and are respectively supported in a state where springs 54 are attached. In a state where the press lever 55 is swung in a direction of pressing the respective pressure rollers 44 to the heat roller 42, the roller shaft 59 is urged by the spring 54, so that the pressure roller 44 is pressed to the heat roller 42. Incidentally, when the heat roller 42 is driven to be rotated, the respective pressure rollers 44 are rotated in a direction shown by an arrow in FIG. 7 (counterclockwise direction) in accordance with the rotation driving of the heat roller 42. Incidentally, in the following description, in the case where the respective pressure rollers 44 are differentiated from each other, they are differentiated by an upstream side pressure roller 44*a* and a downstream side pressure roller 44*b* along the conveyance direction of the sheet 3.

As described above, in a case where the plural pressure rollers 44 are provided, since the sheet 3 can be pressed to the heat roller 42 by those plural pressure rollers 44, the contact area of the sheet 3 to the heat roller 42 can be increased. Thus, the sheet 3 can be quickly and assuredly fixed, and speedup of thermal fixation (for example, about 100 mm/sec in terms of printing speed) and miniaturization can be realized.

The conveyance mechanism section 45 is disposed at the conveyance direction downstream side with respect to the heat roller 42 and the pressure roller 44, and includes the conveyance roller 61 as the conveyance member and the first conveyance roller, and the plural pinch rollers 62 as the second conveyance rollers disposed above the conveyance roller 61 to face thereto.

As shown in FIG. 3, the conveyance roller 61 is such that a roller 64 made of rubber material having a larger dynamic friction coefficient than the first guide member 76 made of a steel plate covers the roller shaft 63 made of metal, and is disposed to face the heat roller 42 through the erection frame 56 in the conveyance direction of the sheet 3, and although not shown in FIG. 2, the roller shaft 63 (see FIG. 3) is inserted in the respective support plates 50, so that the conveyance roller is rotatably supported between the support plates 50 along the axial direction of the heat roller 42.

More specifically, the conveyance roller 61 is disposed so that as shown in FIG. 7, at a position of the conveyance direction downstream side of the heat roller 42 and the conveyance direction upstream side of a conveyance position (contact portion between the conveyance roller 61 and an after-mentioned upstream side pinch roller 62*a*, hereinafter simply referred to as "conveyance position") of the sheet 3 in the conveyance mechanism section 45, a part of the conveyance roller at the conveyance direction upstream side with respect to the conveyance position protrudes above a line segment T2 connecting a contact portion between the heat roller 42 and the downstream side pressure roller 44*b* and the conveyance position.

Then, when power is inputted from the not-shown motor through the input gear 58, the transmission gear 77 and the not-shown conveyance roller drive gear, the conveyance roller 61 is driven to be rotated in the arrow direction (counterclockwise direction).

As shown in FIG. 2, in each of the pinch roller support parts 65 of the fixation frame 49, a plurality of pairs, two pairs in the embodiment, of pinch rollers 62 are provided to successively face and come in contact with the conveyance roller 61 from above in the conveyance direction of the sheet 3.

That is, as shown in FIG. 8, between the second guide members 85 of the pinch roller support part 65 facing each other, two support shafts 86 are received in respective support grooves 87 and are supported by an engagement tool 88 rotatably and movably in the vertical direction. The two pinch rollers 62 are provided side by side as one pair in the axial direction to the respective support shafts 86. Incidentally, when the conveyance roller 61 is driven to be rotated, each of the pinch rollers 62 is rotated in a direction shown by an arrow in FIG. 7 (clockwise direction) in accordance with the rotation driving of the conveyance roller 61.

Hereinafter, in the case where the respective pinch rollers 62 need to be differentiated from each other in the conveyance direction of the sheet 3, they are differentiated by an upstream side pinch roller 62*a* and a downstream side pinch roller 62*b* along the conveyance direction of the sheet 3.

In the conveyance mechanism section 45, the rotation speed of the conveyance roller 61 is slightly higher than the rotation speed of the heat roller 42, so that the speed at which the sheet 3 is conveyed by the conveyance roller 61 and the pinch rollers 62 becomes slightly higher than the speed at which the sheet 3 is conveyed by the heat roller 42 and the pressure rollers 44, and in the embodiment, when the rotation speed of the heat roller 42 is made 100%, the rotation speed of the conveyance roller 61 is set to exceed 100% and not to be larger than approximately 103%.

As shown in FIG. 2, at positions where the respective pinch roller support parts 65 are provided at the erection frame 56 of the fixation frame 49, as shown in FIG. 8, a plurality of, four in the embodiment, peeling pawls 46 are provided to swing and to be capable of coming in contact with and separating from the heat roller 42 in a state where they face the heat roller 42 from the conveyance direction downstream side to the upstream side.

Each of the peeling pawls 46 includes a pawl main body 91, a tip portion 92 coming in contact with the surface of the heat roller 42, a contact portion 93 as a separating member coming in contact with the sheet 3 peeled off from the heat roller 42 and for separating the tip portion 92 from the surface of the heat roller 42, and a guiding portion 94 for guiding the peeled sheet 3 to the conveyance mechanism section 45, and is integrally formed by, for example, integral molding of heat resistant resin such as polyphenylene sulfide (PPS). As described above, when the peeling pawl 46 is integrally formed, the manufacturing process can be reduced, and the number of parts and the cost can be reduced.

As shown in FIG. 2, the pawl main body 91 is swingably provided through a swing shaft 96 to a peeling pawl attachment plate 95 (see FIG. 8) formed to protrude downward from the erection frame 56 at a position where the pinch roller support part 65 of the erection frame 56 is provided.

As shown in FIG. 8, the tip portion 92 extends from the pawl main body 91 to the heat roller 42, and is formed so that a portion sandwiched between an upper surface 97 and a lower surface 98 becomes substantially wedge-shaped. The tip of the tip portion 92 is formed to be sharp, and is formed so that at the downstream side of the contact portion between the heat roller 42 and the downstream side pressure roller 44*b* in the rotation direction of the heat roller 42, its tip comes in contact with the surface of the heat roller 42 from the facing direction to the rotation direction of the heat roller 42.

Figure 11:
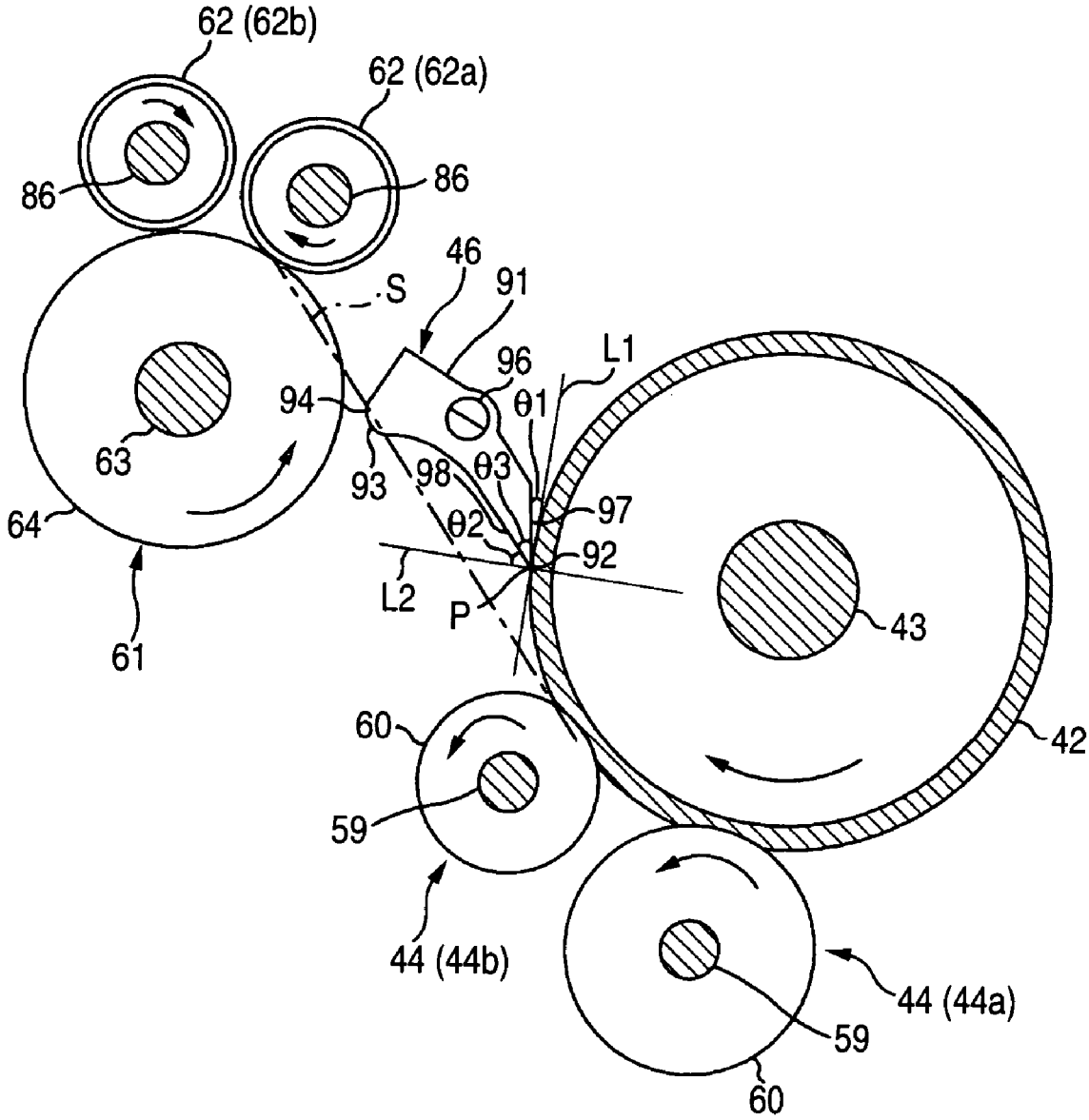
FIG. 11 is an enlarged sectional view of the fixing section shown in FIG. 8.

More specifically, as shown in FIG. 11, in a state where the tip portion 92 of the peeling pawl 46 is in contact with the heat roller 42, the tip portion 92 is set so that an angle θ1 between a tangential line L1 of a contacting point P between the heat roller 42 and the tip portion 92 and the upper surface 97 closer to the tangential line L1 is from 0° to 45° (in the embodiment, 30°). An angle θ2 between an orthogonal line L2 orthogonal to the tangential line L1 at the contacting point P and the lower surface 98 closer to the orthogonal line L2 is set to be 15° or larger (in the embodiment, 45°) An angle θ3 between the upper surface 97 and the lower surface 98 at the tip portion 92 is set to be 10° or larger (in the embodiment, 30°).

Incidentally, the orthogonal line L2 corresponds to a "normal line" according to the present invention, the normal line in which normal to the surface of the heat roller 42 at the contacting point.

When the angle θ1 between the tangential line L1 of the contacting point P of the heat roller 42 and the upper surface 97 is from 0° to 45°, the tip portion 92 does not dig into the heat roller 42 to such a degree that it damages the heat roller 42, and can be brought into contact with the heat roller 42. When the angle θ2 between the orthogonal line L2 and the lower surface 98 is 15° or larger, the sheet 3 can be smoothly peeled off from the heat roller 42. When the angle θ3 between the upper surface 97 and the lower surface 98 is 10° or larger, the strength of the tip portion 92 can be secured. Thus, by forming the tip portion 92 into the shape as stated above, the sheet 3 can be smoothly peeled off from the heat roller 42 while the heat roller 42 is not damaged over a long period.

As shown in FIG. 2, the tip portion 92 is set so that a width W along the axial direction of the opposite heat roller 42 is from 0.5 mm to 1.5 mm (in the embodiment, 0.9 mm).

That is, as the width W of the tip portion 92 becomes short, the deposition of the toner is decreased, however, when it is excessively short, its forming becomes difficult, or the heat roller 42 may be damaged. When the width W of the tip portion 92 is set as stated above, while the deposition of the toner is decreased, the damage of the heat roller 42 is prevented, and the durability can be improved.

As shown in FIG. 8, the contact portion 93 is continuously formed from the lower surface 98 of the tip portion 92 at the lower part of the pawl main body 91, and is formed to bulge as a curved surface bent substantially fanwise from the end of the lower surface 98 at the conveyance direction downstream side. More specifically, as shown in FIG. 11, in a state where the tip portion 92 of the peeling pawl 46 is in contact with the heat roller 42, the contact portion 93 expands toward a line segment S extending from a portion between the heat roller 42 and the downstream side pressure roller 44*b* to a portion between the conveyance roller 61 and the upstream side pinch roller 62*a*, and is formed to protrude obliquely downward from the pawl main body 91, so that the contact portion has a portion intersecting with the line segment S.

More specifically, one side end (end at the conveyance direction upstream side) of the line segment S may be one of the contact portion between the heat roller 42 and the downstream side pressure roller 44*b*, the tangential line of the heat roller 42, and the tangential line of the downstream side pressure roller 44*b*, and the other side end (end at the conveyance direction downstream side) thereof may be one of the contact portion between the conveyance roller 61 and the upstream side pinch roller 62*a*, the tangential line of the conveyance roller 61, and the tangential line of the upstream side pinch roller 62*a* (that is, the line segment may be one of the nine line segments S in total based on these combinations).

The guiding portion 94 is formed as the conveyance direction downstream side portion in the contact portion 93 curved substantially fanwise, and is formed as a curved surface of a bow shape so that the sheet 3 brought into contact with the contact portion 93 can be guided to the contact portion between the conveyance roller 61 and the upstream side pinch roller 62*a*, more specifically, upward.

Then, as the whole including the pawl main body 91, the tip portion 92, the contact portion 93 and the guiding portion 94, and substantially at the center part of the sheet 3 in the conveyance direction, the peeling pawl 46 is supported by the swing shaft 96 at such a position that in the state where it is supported by the swing shaft 96, the center of gravity is disposed so that the tip portion 92 is usually urged to the surface of the heat roller 42 by its own weight, and the tip portion 92 comes in contact with the surface of the heat roller 42. The peeling pawl 46 is set to be urged to the heat roller 42 by an urging force of 0.005×9.8 N (5 gf) or less (in the embodiment, 0.002×9.8 N).

The thermistor 47 is a contact type temperature sensor, and is formed, as shown in FIG. 2, into a flat rectangular shape having elasticity, and at the upstream side of the contact portion between the heat roller 42 and the upstream side pressure roller 44*a* in the rotation direction of the heat roller 42 and at the center portion of the heat roller 42 in the axial direction, its base end is supported at the side cover plate 74 of the erection frame 56 of the fixation frame 49 so that its free end comes in contact with the surface of the heat roller 42.

The thermistor 47 detects the surface temperature of the heat roller 42 and inputs a detection signal to a not-shown CPU, and the CPU controls the drive and stop of the fixation heater 43 on the basis of the detection signal from the thermistor 47, and keeps the surface temperature of the heat roller 42 at a set thermal fixation temperature.

The plurality of thermostats 48 (two in the embodiment) are provided above the heat roller 42 at the opposite side with respect to the pressure roller 44 and along the axial direction at the upstream side of the contact portion between the heat roller 42 and the upstream side pressure roller 44*a* in the rotation direction of the heat roller 42. As shown in FIG. 8, the respective thermostats 48 are supported by a cover member 70 covering the upper part of the fixation frame 49, and includes a bimetal casing 66 and a bimetal 67 (more specifically, reference numeral 67 indicates a protrusion member of the bimetal) contained in the bimetal casing 66.

The bimetal 67 is made of metal which is deformed by heat, and is formed of, for example, alloy which is thermally deformed at a temperature exceeding thermal fixation temperature.

The respective thermostats 48, when the fixation heater 43 does not operate normally by an erroneous operation of the not-shown CPU or a circuit, and the surface of the heat roller 42 is excessively heated up to a temperature exceeding the set fixation temperature and reaches the heat deformation temperature of the bimetal 67, the bimetal 67 is thermally deformed and cuts off power application to the fixation heater 47, whereby the overheat of the heat roller 42 is prevented.

Further, in the fixing section 20, even in the case where the bimetal 67 is not deformed by heat in the respective thermostats 48, when the surface of the heat roller 42 is further excessively heated and reaches a temperature at which the bearing member 51 is melted, the bearing member 51 is softened, and the heat roller 42 is moved upward by the urging force exerted from the respective pressure rollers 44. Then, since the bimetal 67 is mechanically pressed by the heat roller 42, the power application to the fixation heater 47 is cut off by the mechanical deformation of the bimetal 67, whereby the overheat of the heat roller 42 can be prevented.

Incidentally, in the fixing section 20 and in each of the thermostats 48, a flat plate heat conduction member 71 supported by the bimetal casing 66 or the erection frame 56 is made intervene between the bimetal 67 and the surface of the heat roller 42, and the responsiveness of the respective thermostats 48 is improved.

In the fixing section 20, as shown in FIG. 1, during a period when the sheet 3 conveyed from the transfer position successively passes through between the heat roller 42 and the plural pressure rollers 44, the toner image transferred on the sheet 3 is thermally fixed, and then, the sheet 3 is conveyed in the conveyance mechanism section 45 while it is held between the conveyance roller 61 and the pinch roller 62, and is conveyed to a paper ejection path 78.

Figure 9:
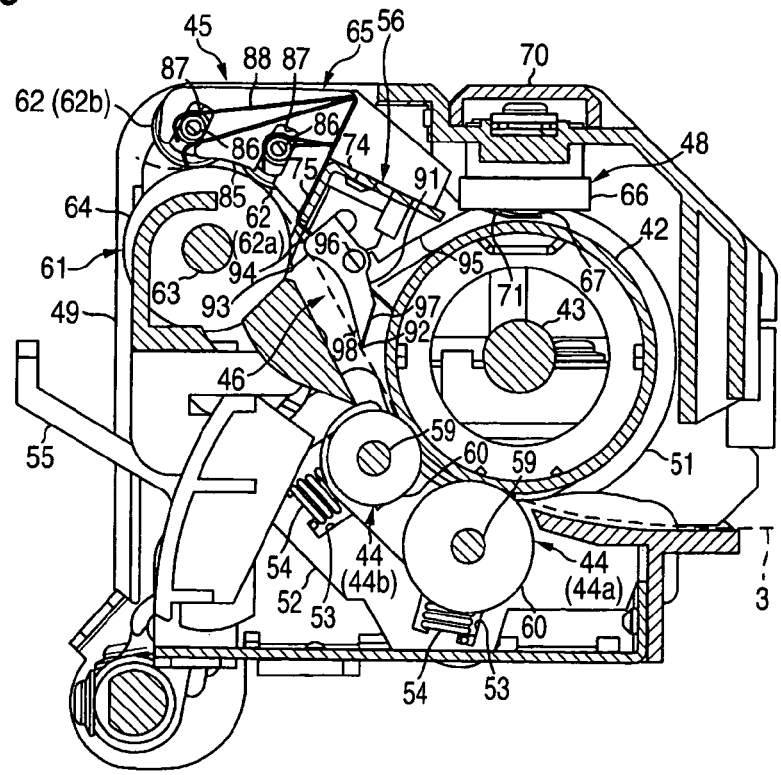
FIG. 9 is a sectional view (a state in which an intermediate part of the sheet passes through between the heat roller and the respective pressure rollers, and the peeling pawl is separated from the heat roller) taken along the line IV—IV shown in FIG. 2.

At this time, in the fixing section 20, as shown in FIG. 8, the front end (conveyance direction downstream side end) of the sheet 3 having passed through between the heat roller 42 and the downstream side pressure roller 44*b* first comes in contact with the tip portion 92 of the peeling pawl 46 being in contact with the heat roller 42, and is peeled off from the surface of the heat roller 42. Subsequently, as shown in FIG. 9, the front end of the sheet 3 peeled off from the surface of the heat roller 42 comes in contact with the contact portion 93 of the peeling pawl 46, and reaches the conveyance mechanism section 45 while being guided by the guiding portion 94, and in the conveyance mechanism section 45, the sheet is conveyed while being held between the conveyance roller 61 and the pinch roller 62.

At this time, the sheet 3 is held between the heat roller 42 and the respective pressure rollers 44 at the conveyance direction upstream side, and is held between the conveyance roller 61 and the respective pinch rollers 62 at the conveyance direction downstream side, and accordingly, the tensile force is given therebetween. Since the contact portion 93 of the peeling pawl 46 coming in contact with the sheet 3 is pressed by the tensile force toward the direction opposite to the protrusion direction from the pawl main body 91, that is, obliquely upward, and as a result, the peeling pawl 46 is swung in the clockwise direction against the urging force due to the weight of peeling pawl 46 itself while the swing shaft 96 is made a fulcrum, and the tip portion 92 is separated from the surface of the heat roller 42.

Figure 10:
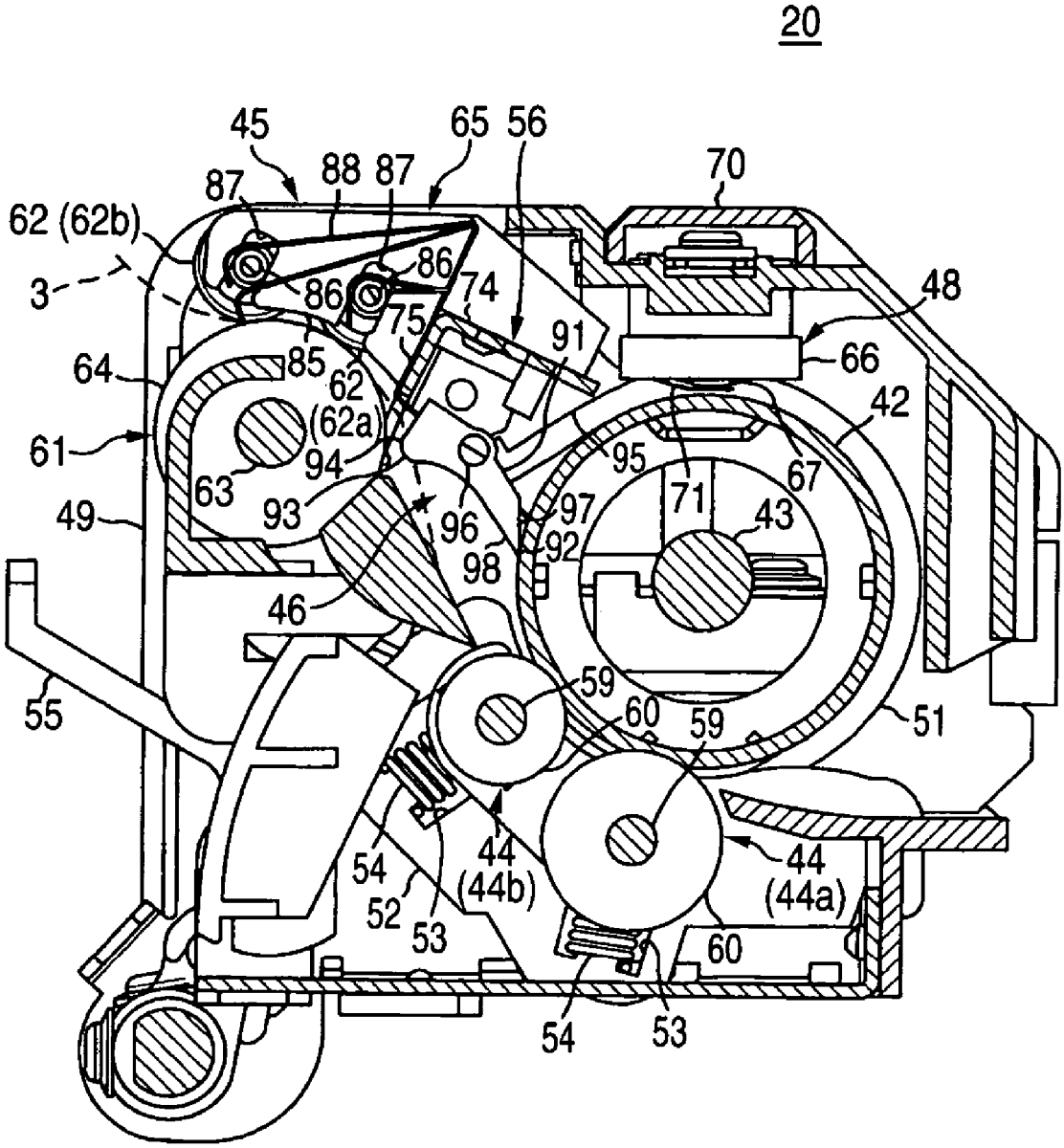
FIG. 10 is a sectional view (a state in which the rear end of the sheet passes through between the heat roller and the respective pressure rollers, and the peeling pawl is in contact with the heat roller) taken along the line IV—IV shown in FIG. 2.

Thereafter, as shown in FIG. 10, when the rear end of the sheet 3 passes through between the heat roller 42 and the downstream side pressure roller 44*b*, since the tensile force of the sheet 3 is lost, the tip portion 92 of the peeling pawl 46 is urged toward the surface of the heat roller 42 by its own weight, and the tip portion 92 again comes in contact with the surface of the heat roller 42.

As a result, in the fixing section 20, during the fixation operation, each time the sheet 3 passes through between the heat roller 42 and the downstream side pressure roller 44*b*, the tip portion 92 of the peeling pawl 46 can be separated from the surface of the heat roller 42. More specifically, in the case where the sheet 3 is, for example, A4 size, except a period when the front end of about 30 mm of the sheet 3 passes through between the heat roller 42 and the downstream side pressure roller 44*b*, and a period when the rear end of about 30 mm of the sheet 3 passes through between the heat roller 42 and the downstream side pressure roller 44*b*, the tip portion 92 of the peeling pawl 46 can be separated from the surface of the heat roller 42 in a period when the remaining intermediate part of 240 mm passes through between the heat roller 42 and the downstream side pressure roller 44*b*.

Thereafter, as shown in FIG. 1, the sheet 3 sent to the paper ejection path 78 is sent to a paper ejection roller 79, and is ejected to a paper ejection tray 80 by the paper ejection roller 79.

As shown in FIG. 1, in the laser printer 1, a reversal conveyance part 81 is provided for the purpose of forming images on both sides of the sheet 3. The reversal conveyance part 81 includes the paper ejection roller 79, a reversal conveyance path 82, a flapper 83, and plural reversal conveyance rollers 84.

The paper ejection roller 79 is made of a pair of rollers, and is provided so that the forward rotation and the reverse rotation can be changed. As described above, in the case where the sheet 3 is ejected onto the paper ejection tray 80, the paper ejection roller 79 is rotated in the forward direction, and in the case where the sheet 3 is reversed, the paper ejection roller 79 is rotated in the reverse direction.

The reversal conveyance path 82 is provided along the vertical direction so that the sheet 3 can be conveyed from the paper ejection roller 79 to the plural reversal conveyance rollers 84 disposed below the image formation part 5, its upstream side end is disposed near the paper ejection roller 79, and its downstream side end is disposed near the reversal conveyance roller 84.

The flapper 83 is swingably provided to face a branch portion between the paper ejection path 78 and the reversal conveyance path 82, and is provide to be capable of changing the conveyance direction of the sheet 3 reversed by the paper ejection roller 79 from the direction toward the paper ejection path 78 to the direction toward the reversal conveyance path 82 by excitation or non-excitation of a not-shown solenoid.

The plural reversal conveyance rollers 84 are provided above the sheet feed tray 6 in the substantially horizontal direction, the reversal conveyance roller 84 at the most upstream side is disposed near the rear end of the reversal conveyance path 82, and the reversal conveyance roller 84 at the most downstream side is disposed below the registration roller 12.

In a case where images are formed on both sides of the sheet 3, the reversal conveyance part 81 is operated as follows. That is, when the sheet 3 on one side of which an image is formed is sent by the conveyance mechanism section 45 from the paper ejection path 78 to the paper ejection roller 79, the paper ejection roller 79 is forward rotated in a state where it holds the sheet 3, and once conveys the sheet 3 to the outside (side of the paper ejection tray 80), and when most of the sheet 3 is sent to the outside and the rear end of the sheet 3 is held by the paper ejection roller 79, the forward rotation is stopped. Next, the paper ejection roller 79 is reversely rotated, the flapper 83 changes the conveyance direction so that the sheet 3 is conveyed to the reversal conveyance path 82, and the sheet 3 is conveyed to the reversal conveyance path 82 in a state where the front and the rear are reversed. Incidentally, when the conveyance of the sheet 3 is ended, the flapper 83 is changed into the original state, that is, the state in which the sheet 3 sent from the conveyance mechanism section 45 is sent to the paper ejection roller 79. Next, the sheet 3 conveyed to the reversal conveyance path 82 in the reverse direction is conveyed to the reversal conveyance rollers 84, and is sent from the reversal conveyance rollers 84 to the registration roller 12 while being reversed upward. The sheet 3 conveyed to the registration roller 12 is again sent, in the reversed state, to the image formation position after registration, whereby images are formed on both the sides of the sheet.

As set forth above, in the fixing section 20, when the sheet 3 passes through between the heat roller 42 and the respective pressure rollers 44, the tip portion 92 of the peeling pawl 46 urged to the heat roller 42 by its own weight peels off the sheet 3 from the surface of the heat roller 42. On the other hand, the sheet 3 peeled off from the heat roller 42 is held between the heat roller 42 and the respective pressure rollers 44 at the conveyance direction upstream side, and is held between the conveyance roller 61 and the respective pinch rollers 62 at the conveyance direction downstream side, and as a result, when the tensile force is given to the sheet 3, the contact portion 93 of the peeling pawl 46 coming in contact with the sheet 3 is pressed, and the peeling pawl 46 is separated from the surface of the heat roller 42 against the urging force by its own weight.

Thus, even if a large expensive mechanism is not provided, by the simple structure, during the fixation operation, each time the sheet 3 passes through between the heat roller 42 and the downstream side pressure roller 44*b*, except when the need arises (that is, except when the front end of the sheet 3 passes through between the heat roller 42 and the downstream side pressure roller 44*b*), the peeling pawl 46 can be separated from the heat roller 42 to the extent possible. As a result, during the fixation operation, as compared with the case where the peeling pawl 46 is always in contact with the heat roller 42, it is possible to reduce such disadvantage that the toner is deposited on the peeling pawl 46, the deposited toner is again adhered to the heat roller 42, and the sheet 3 is stained, or the heat roller 42 is worn down by the continuous contact during the fixation operation, and the durability is lowered.

Since the peeling pawl 46 is provided to be urged to the surface of the heat roller 46 by its own weight, it is not necessary to specially provide an urging unit, and the structure can be simplified. More specifically, since the peeling pawl 46 is set to be urged to the heat roller 42 by its own weight and by an urging force of 0.005×9.8 N (5 gf) or less as described above, even if the peeling pawl 46 is brought into contact with the surface of the heat roller 42, the sheet 3 can be excellently peeled off, while the surface of the heat roller 42 is not damaged. Incidentally, the urging force of the peeling pawl 46 to the heat roller 42 may be, for example, 0 N (0 gf) as long as the contact occurs.

Further, since the peeling pawl 46 is swingably provided, the peeling pawl 46 can be assuredly separated from the heat roller 42. Thus, the certain separating operation of the peeling pawl 46 can be secured by the simple structure.

Further, since the contact portion 93 of the peeling pawl 46 is formed as the curved surface bent substantially fanwise from the conveyance direction downstream side end of the lower surface 98, and the contact portion 93 comes in contact with the sheet 3 at the curved surface, the peeling pawl 46 can be separated from the heat roller 42, while for example, such damage that the sheet 3 is streaked is prevented.

Since the sheet 3 peeled off from the heat roller 42 and brought into contact with the contact portion 93 is further guided to the contact portion between the conveyance roller 61 and the upstream side pinch roller 62*a* by the guiding portion 94 of the peeling pawl 46, the smooth conveyance of the sheet 3 can be secured.

In the fixing section 20, since the speed at which the sheet 3 is conveyed by the conveyance roller 61 and the respective pinch rollers 62 is set to be slightly higher than the speed at which the sheet 3 is conveyed by the heat roller 42 and the respective pressure rollers 44, when the sheet 3 is held between a position of the heat roller 42 and the respective pressure rollers 44 and a position of the conveyance roller 61 and the respective pinch rollers 62, the tensile force can be assuredly given to the sheet 3. Thus, the peeling pawl 46 can be assuredly separated from the heat roller 42 by the contact of the sheet 3 to the contact portion 93 of the peeling pawl 46.

Then, according to the laser printer 1, in the fixing section 20, since the peeling pawl 46 can be separated by the simple structure from the heat roller 42 during the fixation operation except when the need arises, the durability can be improved, and the excellent image formation can be achieved over a long period.

Incidentally, in the above description, the structure is such that the sheet 3 separated from the heat roller 42 is held between the heat roller 42 and the respective pressure rollers 44 at the conveyance direction upstream side, and is held between the conveyance roller 61 and the respective pinch rollers 62 at the conveyance direction downstream side, and when the tensile force is given to the sheet 3, the contact portion 93 of the peeling pawl 46 is pressed by the sheet 3, so that the peeling pawl 46 is swung, and the tip portion 92 of the peeling pawl 46 is separated from the surface of the heat roller 42. However, the structure may be such that for example, even if the tensile force is not given to the sheet 3, the contact portion 93 of the peeling pawl 46 is pressed by the firmness of the sheet 3 itself, and the tip portion 92 of the peeling pawl 46 is separated from the surface of the heat roller 42.

Although the peeling pawl 46 is swingably provided, for example, the peeling pawl 46 may be slidably provided in the direction where it comes in contact with and separated from the heat roller 42.

Figure 12:
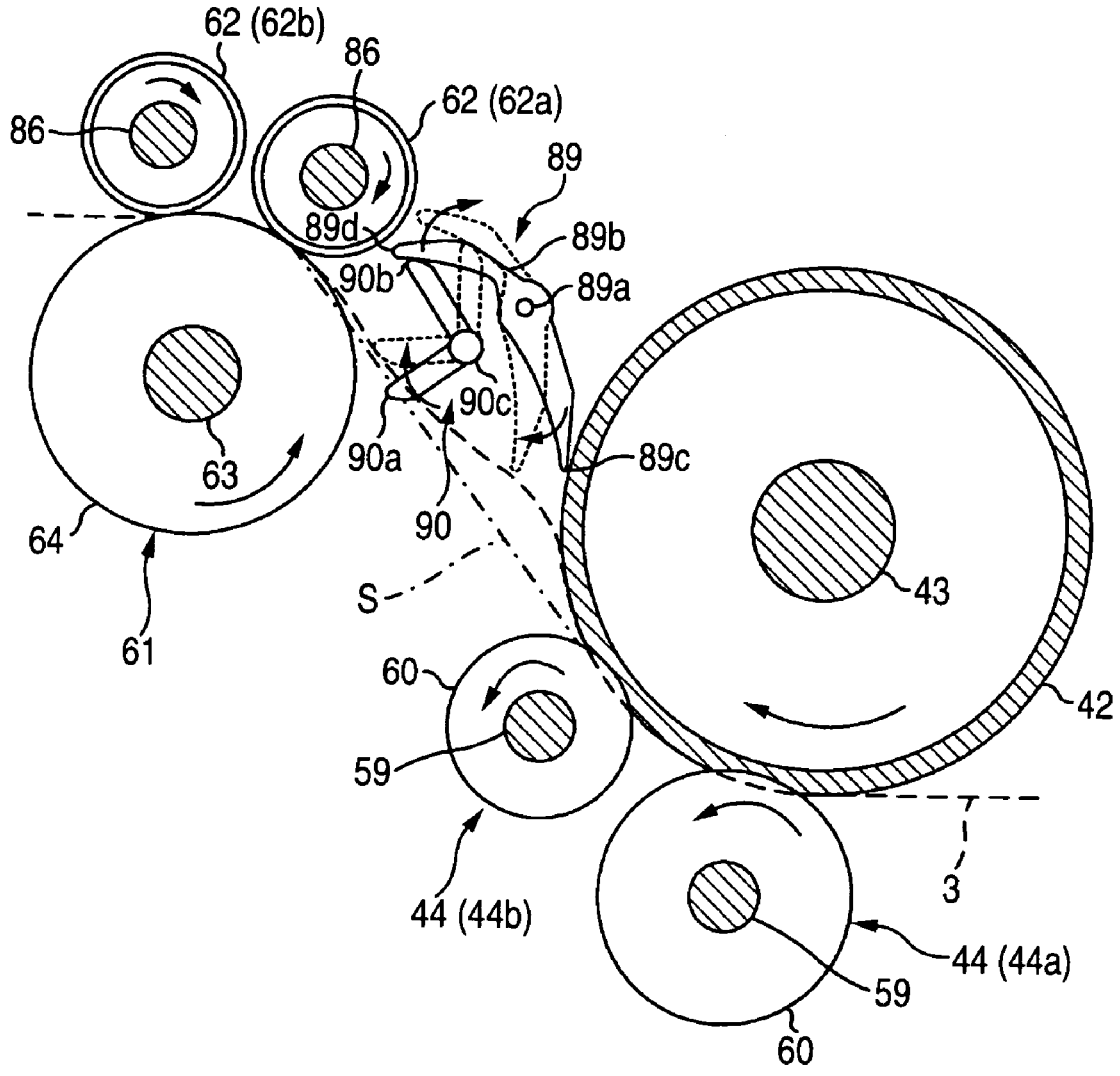
FIG. 12 is an enlarged sectional view showing another configuration (the configuration in which a separating member is provided as an individual body) of a peeling pawl in the laser printer.

In the above description, although the peeling member and the separating member of the invention are formed integrally as the peeling pawl 46, for example, as shown in FIG. 12, a separating member 90 may be provided as a body individual from a peeling pawl 89 as a peeling member. That is, in FIG. 12, in the peeling pawl 89, a pawl main body 89*b* supported by a swing shaft 89*a*, a tip portion 89*c* coming in contact with the heat roller 42, and a rear end portion 89*d* provided to the swing shaft 89*a* at the opposite side to the tip portion 89*c* are integrally formed.

The separating member 90 is formed to be substantially L-letter shaped, a bent portion 90*c* is swingably supported, one piece 90*a* faces the line segment S, and the other piece 90*b* is disposed to be capable of coming in contact with the rear end portion 89*d* of the peeling pawl 89.

In the configuration shown in FIG. 12, the front end of the sheet 3 having passed through between the heat roller 42 and the downstream side pressure roller 44*b* first comes in contact with the tip portion 89*c* of the peeling pawl 89 being in contact with the heat roller 42, and is peeled off from the surface of the heat roller 42. Thereafter, the front end of the sheet 3 peeled off from the surface of the heat roller 42 comes in contact with the one piece 90*a* of the separating member 90, and the one piece 90*a* is pressed to the conveyance direction downstream side. Then, since the separating member 90 is rotated in clockwise direction, the other piece 89*b* of the separating member 90 presses the rear end portion 89*d* of the peeling pawl 89, whereby the peeling pawl 89 is rotated in clockwise direction while the swing shaft 89*a* is made a fulcrum, and the tip portion 89*c* of the peeling pawl 89 is separated from the surface of the heat roller 42.

Due to the peeling pawl 89 and the separating member 90 as stated above, each time the sheet 3 passes through between the heat roller 42 and the downstream side pressure roller 44*b*, the peeling pawl 89 can be separated from the heat roller 42 by the simple structure during the fixation operation except when the need arises.

Due to the configuration that the peeling pawl 89 and the separating member 90 being formed as the individual bodies as stated above, the peeling pawl 89 can be formed of a material suitable for peeling the sheet 3 from the heat roller 42, for example, a heat resistant resin such as polyimide, polyamide, or polyamidoimide, one obtained by coating or mixing the resin as stated above with a fluorine resin in order to give release properties, or a resin having heat resistance and release properties, such as tetrafluoroethylene-perfluoroalkyl vinyl ether copolymer (PFA), and on the other hand, the separating member 90 can be formed of a material suitable for contact with the sheet 3, for example, an inexpensive general-purpose resin such as polyethylene, polypropylene, or polyethylene terephthalate. By making the peeling pawl 89 and the separating member 90 out of such materials, the cost can be reduced while these certain actions are secured.

Figure 4:
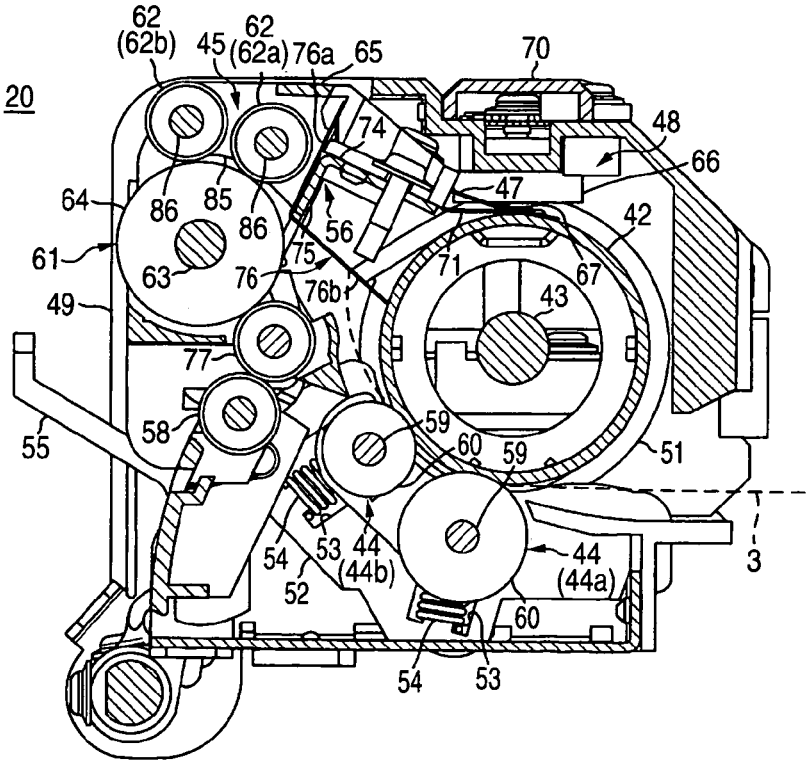
FIG. 4 is a sectional view (a state in which the front end of a curled sheet is in contact with a first guide member) taken along the line IV—IV shown in FIG. 2.
Figure 5:
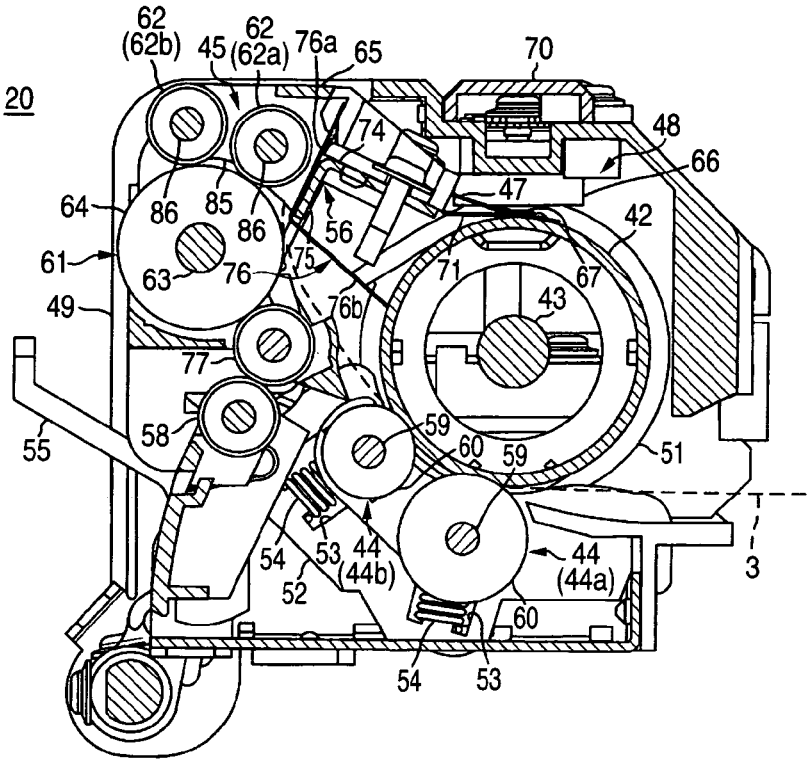
FIG. 5 is a sectional view (a state in which the front end of the curled sheet is in contact with a conveyance roller) taken along the line III—III shown in FIG. 2.
Figure 6:
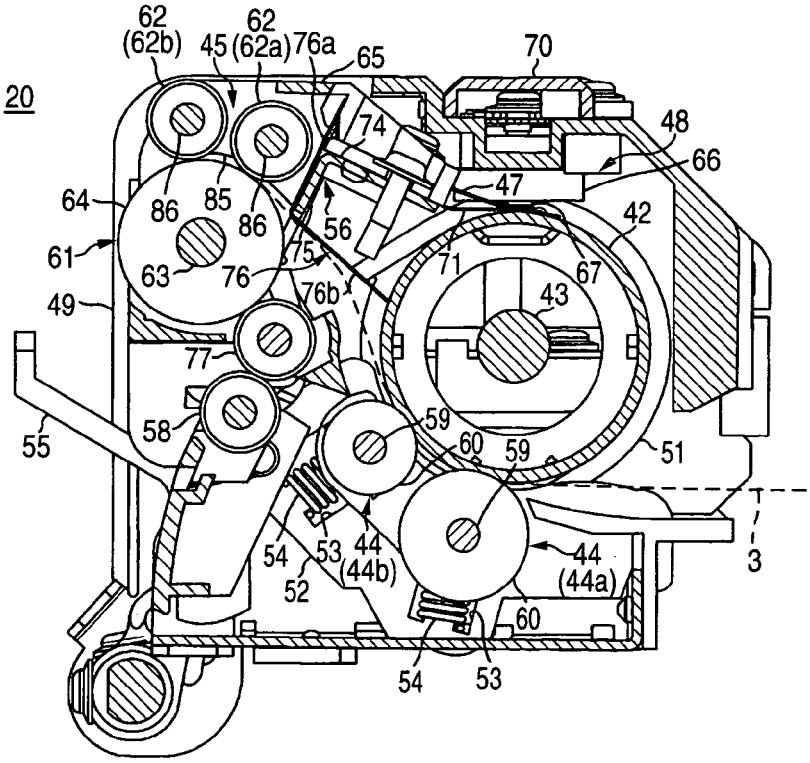
FIG. 6 is a sectional view (a state in which the sheet is conveyed to a conveyance position while being flattened out in the opposite direction to a curl direction of the front end of the sheet by the conveyance roller) taken along the line III—III shown in FIG. 2.

In the fixing section 20, for example, even if the front end of the sheet 3 having passed through between the heat roller 42 and the downstream side pressure roller 44*b* has an arc-shaped curl in the same direction as the surface shape of the heat roller 42, as shown in FIG. 4, the front end of the sheet 3 having the curl first comes in contact with the guide piece 76*b* of the first guide member 76, and is guided to the conveyance position of the sheet 3 in the conveyance mechanism section 45 by the guide piece 76*b* of the first guide member 76 in accordance with the sending out of the sheet 3 from between the heat roller 42 and the pressure roller 44. As shown in FIG. 5, at the conveyance direction upstream side of the conveyance position, the front end of the sheet 3 having the curl, especially its surface which is opposite to the surface brought into contact with the heat roller 42, next comes in contact with the conveyance roller 61, and as shown in FIG. 6, the sheet is conveyed to the conveyance position while being flattened out in the reverse direction to the curl direction of the front end of the sheet 3 by the conveyance roller 61. Thus, while the occurrence of a jam due to the bending of the sheet 3 is prevented, the sheet 3 can be assuredly guided to the conveyance position.

In the fixing section 20, the conveyance roller 61 conveys the curled sheet 3 to the conveyance position while flattening it in the reverse direction to the curl direction, and conveys it while holding the sheet 3 against the pinch roller 62 at the conveyance position, that is, the conveyance roller serves as both the roller for conveying the sheet to the conveyance position and the roller for conveying it at the conveyance position, the number of parts is reduced and the apparatus structure can be simplified.

As shown in FIG. 7, since a part of the conveyance roller 61 at the conveyance direction upstream side with respect to the conveyance position is disposed above the line segment T2 connecting the contact portion between the heat roller 42 and the downstream side pressure roller 44*b* and the conveyance position, the conveyance roller 61 is assuredly brought into contact with the sheet 3 having passed through between the heat roller 42 and the pressure roller 44, and the sheet 3 can be assuredly conveyed in the opposite direction to the curl direction. Thus, the sheet 3 can be assuredly guided to the conveyance position, and the occurrence of a jam in the fixing section 20 can be further reduced.

In the fixing section 20, since the sheet 3 guided to the conveyance mechanism section 45 is conveyed between the conveyance roller 61 and both the upstream side pinch roller 62*a* and the downstream side pinch roller 62*b* while being successively held, the portion of the sheet 3 held between the conveyance roller 61 and the pinch rollers 62 can be made larger than that in the case where the single pinch roller 62 is provided in the conveyance direction of the sheet 3. Thus, the sheet 3 is more flattened out between the conveyance roller 61 and both the upstream side pinch roller 62*a* and the downstream side pinch roller 62*b*, and the curl of the sheet 3 can be corrected.

In the fixing section 20, as shown in FIG. 7, since the guide piece 76*b* of the first guide member 76 is disposed along the direction in which the line C intersecting with the tangential line Q of the contact portion between the heat roller 42 and the downstream side pressure roller 44*b* is extended, the sheet 3 conveyed by the conveyance roller 61 can be assuredly guided to the conveyance mechanism section 45. Thus, the occurrence of a jam in the fixing section 20 can be further reduced.

As described above, since the first guide member 76 is disposed at the downstream side away by 5 mm or more from the most downstream portion of the contact portion between the heat roller 42 and the downstream side pressure roller 44*b* in the rotation direction of the heat roller 42, and along the line T1 passing through the conveyance direction upstream side end of the guide piece 76*b* of the first guide member 76 from the rotation center O of the heat roller 42, or is provided to be inclined with respect to the line T1 in the direction in which the conveyance direction downstream side end of the guide piece 76*b* of the first guide member 76 is separated from the conveyance roller 61, it is possible to prevent the jam from occurring by the contact of the sheet 3 to the guide piece 76*b* of the first guide member 76.

In the fixing section 20, the roller 64 of the conveyance roller 61 is formed of the rubber material, and the first guide part 76 is formed of the steel plate, and since the dynamic friction coefficient of the surface of the roller 64 of the conveyance roller 61, which comes in contact with the sheet 3, is larger than the dynamic friction coefficient of the surface of the guide piece 76*b* of the first guide member 76, which comes in contact with the sheet 3, as shown in FIG. 6, in the state where the sheet 3 comes in contact with the guide piece of the first guide member 76 and is guided while being conveyed by the conveyance roller 61, the sheet 3 is assuredly held and conveyed by the conveyance roller 61, and the sheet 3 can be smoothly slid and guided by the first guide member 76.

Since the laser printer 1 includes the fixing section 20 in which the occurrence of the jam can be reduced, the occurrence of the jam in the whole laser printer 1 can be reduced.

According to the present invention, as described above with reference to a specific embodiment, in the state where the fixation medium having passed through between the fixing member and the pressuring member is guided to the conveyance position of the conveying unit by the guide member, the surface opposite to the surface having come in contact with the fixing member comes in contact with the conveyance member, and is conveyed by the conveyance member. Therefore, even if the front end of the fixation medium after passing through between the fixing member and the pressuring member has a curl having the same shape as the surface shape of the fixing member, the fixation medium is conveyed in the opposite direction to the curl direction of the front end by the conveyance member while being guided to the conveyance position of the conveying unit by the guide member, and accordingly, the fixation medium can be assuredly guided to the conveyance position of the conveying unit while the occurrence of the jam is prevented.

According to the present invention, since the conveyance member serves also as the conveying unit, the number of parts is decreased and the device structure can be simplified.

According to the present invention, since the fixation medium guided to the conveying unit is conveyed while being successively held between the first conveyance roller and the plural second conveyance rollers, a portion of the fixation medium which is held between the first conveyance roller and the second conveyance rollers can be made larger than that in a case where a single second conveyance roller is disposed in the conveyance direction of the fixation medium. Therefore, the fixation medium is more flattened out between the first conveyance roller and the plural second conveyance rollers, so that the curl of the fixation medium can be corrected.

According to the present invention, since the fixation medium can be brought into press contact with the fixing member by the plurality of the pressuring members, a contact area of the fixation medium to the fixing member can be increased. Therefore, the fixation medium can be quickly and assuredly fixed, and the speed-up of thermal fixation and the miniaturization of the device can be realized.

According to the present invention, the conveyance member is assuredly brought into contact with the fixation member having passed through between the fixing member and the pressuring member, and the fixation medium can be assuredly conveyed in the opposite direction to the curl direction. Therefore, the fixation medium can be assuredly guided to the conveyance position of the conveying unit, and the occurrence of the jam can be further reduced.

According to the present invention, the conveyance member can be assuredly brought into contact with the fixation medium passing through between the fixing member and the most downstream side pressuring member and entering between the first conveyance roller and the most upstream side second conveyance roller. Therefore, the fixation medium can be more assuredly brought into contact with the conveyance member, and can be more assuredly guided to the conveyance position of the conveying unit.

According to the present invention, since the guide member is disposed along the direction in which the line intersecting with the tangent line of the fixation member at the contact portion with the pressuring member, the fixation medium conveyed by the conveyance member can be assuredly guided to the conveying unit. Therefore, the occurrence of the jam in the thermal fixing device can be further reduced.

According to the present invention, since the guide member is disposed along the direction in which the line intersecting with the tangent line of the fixing member at the contact portion with the most downstream side pressuring member is extended, the fixation medium conveyed by the conveyance member can be more assuredly guided to the conveying unit. Therefore, the occurrence of the jam in the thermal fixing device can be further reduced.

According to the present invention, since the guide member is disposed to be disposed away, at the downstream side, by 5 mm or more along the surface of the fixing roller from the most downstream portion of the contact portion between the fixing roller and the pressuring member in the rotation direction of the fixing roller, and is disposed along the line passing through the one end of the guide member at the side facing the fixing roller from the rotation center of the fixing roller, or is disposed so that the other end of the guide member is separated from the conveyance member with respect to the line, it is possible to prevent the jam from occurring by the contact with the guide member.

According to the present invention, since the dynamic friction coefficient of the conveyance member at the contact portion with the fixation medium is larger than the dynamic friction coefficient of the guide member at the contact portion with the fixation medium, in a state where the fixation medium comes in contact with the guide member and is guided while being conveyed by the conveyance member, the fixation medium can be smoothly slid and guided by the guide member while the fixation medium is assuredly held and conveyed by the conveyance member.

According to the present invention, since the contact portion of the conveyance member with the fixation medium is made of the elastic body, and the contact portion of the guide member with the fixation medium is made of the metal, in the state where the fixation medium comes in contact with the guide member and is guided while being conveyed by the conveyance member, the fixation medium can be slid and guided by the guide member while the fixation medium is assuredly conveyed by the conveyance member.

Since the image forming apparatus according to the invention includes the thermal fixing device that can reduce the occurrence of the jam, the occurrence of the jam in the whole image forming apparatus can be reduced.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A thermal fixing device comprising:

a fixing member disposed to be in contact with a fixation medium;

a pressuring member disposed to face the fixing member and configured to press the fixation medium against the fixing member;

a conveying unit configured to convey the fixation medium that has passed through between the fixing member and the pressuring member; and a guide member configured to guide the fixation medium to the conveyance position;

wherein the conveyance unit comprises, a first conveyance roller configured to convey the fixation medium, and configured to be in contact with the fixation medium on a surface that is opposite to a surface where the fixing roller contacts with at a position that is downstream of the fixing roller with respect to a conveyance direction of the fixation medium and is upstream of a conveyance position where the conveyance unit conveys the fixation medium; and a plurality of second conveyance rollers disposed along the conveyance direction of the fixation medium, and each disposed to face the first conveyance roller to support and convey the fixation medium; and wherein the guide member is disposed to face the first conveyance roller, and a first (downstream) end portion of the guide member is disposed on a line that passes a contact portion between the first conveyance roller and an upstream side second conveyance roller and a second (upstream) end portion of the guide member, wherein the pressuring member comprises a plurality of the pressuring members disposed along the conveyance direction of the fixation medium.

2. The thermal fixing device as claimed in claim 1, wherein a part of the first conveyance roller is disposed on a line connecting the conveyance position and a contact portion where the fixing member contacts the pressuring member.

3. The thermal fixing device as claimed in claim 1, wherein the guide member is disposed along a direction of a line that intersects with a tangential line of the fixing member at a contact portion where the fixing member contacts the pressuring member.

4. The thermal fixing device as claimed in claim 1, wherein a contact portion of the first conveyance roller where the first conveyance roller contacts the fixation medium is made of elastic material, and a contact portion of the guide member where the guide member contacts the fixation medium is made of metal material.

5. The thermal fixing device as claimed in claim 1, wherein a part of the first conveyance roller is disposed on a line connecting the conveyance position and a contact portion where the fixing member contacts the pressuring member.

6. The thermal fixing device as claimed in claim 5, wherein the pressuring member comprises a plurality of the pressuring members disposed along the conveyance direction of the fixation medium, and wherein the line connecting the conveyance position and the contact portion corresponds to a line connecting a portion where the pressuring member that is disposed the most downstream contacts the fixing member and a portion where the first conveyance roller contacts to the second conveyance roller that is disposed the most upstream.

7. The thermal fixing device as claimed in claim 6, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

8. The thermal fixing device as claimed in claim 1, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

9. The thermal fixing device as claimed in claim 1, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed along a line connecting a rotation center of the fixing roller and one end of the guide member which is facing the fixing roller.

10. The thermal fixing device as claimed in claim 1, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed so that one end of the guide member is separated from the first conveyance roller with respect to a line connecting a rotation center of the fixing roller and the other end of the guide member which is facing the fixing roller.

11. An image forming apparatus comprising:

a sheet feeding section configured to feed a sheet; and an image forming section configured to form an image on the sheet fed by the sheet feeding section, wherein the image forming section includes a thermal fixing device comprising:

a fixing member disposed to be in contact with the sheet;

a pressuring member disposed to face the fixing member and configured to press the sheet against the fixing member;

a conveying unit configured to convey the sheet that has passed through between the fixing member and the pressuring member; and a guide member disposed to face the first conveyance roller and configured to guide the sheet to the conveyance position;

wherein the conveyance unit comprises:

a first conveyance roller configured to convey the fixation medium, and configured to be in contact with the fixation medium on a surface that is opposite to a surface where the fixing roller contacts with at a position that is downstream of the fixing roller with respect to a conveyance direction of the fixation medium and is upstream of a conveyance position where the conveyance unit conveys the fixation medium; and a plurality of second conveyance rollers disposed along the conveyance direction of the fixation medium, and each disposed to face the first conveyance roller to support and convey the fixation medium; and wherein the guide member is disposed to face the first conveyance roller, and a first (downstream) end portion of the guide member is disposed on a line that passes a contact portion between the first conveyance roller and an upstream side second conveyance roller and a second (upstream) end portion of the guide member, wherein the pressuring member comprises a plurality of the pressuring members disposed along the conveyance direction of the sheet.

12. The image forming apparatus as claimed in claim 11, wherein a part of the first conveyance roller is disposed on a line connecting the conveyance position and a contact portion where the fixing member contacts the pressuring member.

13. The image forming apparatus as claimed in claim 11, wherein a contact portion of the first conveyance roller where the first conveyance roller contacts the sheet is made of elastic material, and a contact portion of the guide member where the guide member contacts the sheet is made of metal material.

14. The image forming apparatus as claimed in claim 11, wherein a part of the first conveyance roller is disposed on a line connecting the conveyance position and a contact portion where the fixing member contacts the pressuring member.

15. The image forming apparatus as claimed in claim 14, wherein the pressuring member comprises a plurality of the pressuring members disposed along the conveyance direction of the sheet, and wherein the line connecting the conveyance position and the contact portion corresponds to a line connecting a portion where the pressuring member that is disposed the most downstream contacts the fixing member and a portion where the first conveyance roller contacts to the second conveyance roller that is disposed the most upstream.

16. The image forming apparatus as claimed in claim 15, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

17. The image forming apparatus as claimed in claim 11, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

18. The image forming apparatus as claimed in claim 11, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed along a line connecting a rotation center of the fixing roller and one end of the guide member which is facing the fixing roller.

19. The image forming apparatus as claimed in claim 11, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed so that one end of the guide member is separated from the first conveyance roller with respect to a line connecting a rotation center of the fixing roller and the other end of the guide member which is facing the fixing roller.

20. A thermal fixing device comprising:

a fixing member disposed to be in contact with a fixation medium;

a pressuring member disposed to face the fixing member and configured to press the fixation medium against the fixing member;

a conveying unit configured to convey the fixation medium that has passed through between the fixing member and the pressuring member; and a guide member disposed configured to guide the fixation medium to the conveyance position;

wherein the conveyance unit comprises;

a first conveyance roller configured to convey the fixation medium, and configured to be in contact with the fixation medium on a surface that is opposite to a surface where the fixing member contacts with at a position that is downstream of the fixing member with respect to a conveyance direction of the fixation medium and is upstream of a conveyance position where the conveyance unit conveys the fixation medium; and a plurality of second conveyance rollers disposed along the conveyance direction of the fixation medium, and each disposed to face the first conveyance roller to support and convey the fixation medium; and the guide member is disposed away by not less than 5 mm downstream along a surface of the fixing member from a contact portion where the fixing member contacts the pressuring member, and is disposed along a line connecting a rotation center of the fixing member and one end of the guide member which is facing the fixing member.

21. A thermal fixing device comprising:

a fixing member disposed to be in contact with a fixation medium;

a pressuring member disposed to face the fixing member and configured to press the fixation medium against the fixing member;

a conveying unit configured to convey the fixation medium that has passed through between the fixing member and the pressuring member; and a guide member configured to guide the fixation medium to the conveyance position;

wherein the conveyance unit comprises:

a first conveyance roller configured to convey the fixation medium, and configured to be in contact with the fixation medium on a surface that is opposite to a surface where the fixing member contacts with at a position that is downstream of the fixing member with respect to a conveyance direction of the fixation medium and is upstream of a conveyance position where the conveyance unit conveys the fixation medium; and a plurality of second conveyance rollers disposed along the conveyance direction of the fixation medium, and each disposed to face the first conveyance roller to support and convey the fixation medium; and the guide member is disposed away by not less than 5 mm downstream along a surface of the fixing member from a contact portion where the fixing member contacts the pressuring member, and is disposed so that one end of the guide member is separated from the first conveyance roller with respect to a line connecting a rotation center of the fixing member and the other end of the guide member which is facing the fixing member.

22. A thermal fixing device comprising:

a fixing member disposed to be in contact with a fixation medium;

a pressuring member disposed to face the fixing member and configured to press the fixation medium against the fixing member;

a conveying unit configured to convey the fixation medium that has passed through between the fixing member and the pressuring member; and a guide member configured to guide the fixation medium to the conveyance position;

wherein the conveyance unit comprises, a first conveyance roller configured to convey the fixation medium, and configured to be in contact with the fixation medium on a surface that is opposite to a surface where the fixing roller contacts with at a position that is downstream of the fixing roller with respect to a conveyance direction of the fixation medium and is upstream of a conveyance position where the conveyance umt conveys the fixation medium; and a plurality of second conveyance rollers disposed along the conveyance direction of the fixation medium, and each disposed to face the first conveyance roller to support and convey the fixation medium; and wherein the guide member is disposed to face the first conveyance roller, and a first (downstream) end portion of the guide member is disposed on a line that passes a contact portion between the first conveyance roller and an upstream side second conveyance roller and a second (upstream) end portion of the guide member, and wherein the fixing member comprises a fixing roller, and wherein the guide member is disposed away by not less than 5 mm downstream along a surface of the fixing roller from a contact portion where the fixing roller contacts the pressuring member, and is disposed along a line connecting a rotation center of the fixing roller and one end of the guide member which is facing the fixing roller.

23. The thermal fixing device as claimed in claim 22, wherein the pressuring member comprises a plurality of the pressuring members disposed along the conveyance direction of the fixation medium.

24. The thermal fixing device as claimed in claim 23, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

25. The thermal fixing device as claimed in claim 23, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed along a line connecting a rotation center of the fixing roller and one end of the guide member which is facing the fixing roller.

26. The thermal fixing device as claimed in claim 23, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed so that one end of the guide member is separated from the first conveyance roller with respect to a line connecting a rotation center of the fixing roller and the other end of the guide member which is facing the fixing roller.

27. The thermal fixing device as claimed in claim 22, wherein a part of the first conveyance roller is disposed on a line connecting the conveyance position and a contact portion where the fixing member contacts the pressuring member.

28. The thermal fixing device as claimed in claim 22, wherein the guide member is disposed along a direction of a line that intersects with a tangential line of the fixing member at a contact portion where the fixing member contacts the pressuring member.

29. The thermal fixing device as claimed in claim 22, wherein a dynamic friction coefficient of the first conveyance roller at a contact portion where the first conveyance roller contacts the fixation medium is larger than a dynamic friction coefficient of the guide member at a contact portion where the guide member contacts the fixation medium.

30. The thermal fixing device as claimed in claim 22, wherein a contact portion of the first conveyance roller where the first conveyance roller contacts the fixation medium is made of elastic material, and a contact portion of the guide member where the guide member contacts the fixation medium is made of metal material.

31. The thermal fixing device as claimed in claim 22, wherein a part of the first conveyance roller is disposed on a line connecting the conveyance position and a contact portion where the fixing member contacts the pressuring member.

32. The thermal fixing device as claimed in claim 31, wherein the pressuring member comprises a plurality of the pressuring members disposed along the conveyance direction of the fixation medium, and wherein the line connecting the conveyance position and the contact portion corresponds to a line connecting a portion where the pressuring member that is disposed the most downstream contacts the fixing member and a portion where the first conveyance roller contacts to the second conveyance roller that is disposed the most upstream.

33. The thermal fixing device as claimed in claim 32, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

34. A thermal fixing device comprising:

a fixing member disposed to be in contact with a fixation medium;

a pressuring member disposed to face the fixing member and configured to press the fixation medium against the fixing member;

a conveying unit configured to convey the fixation medium that has passed through between the fixing member and the pressuring member; and a guide member configured to guide the fixation medium to the conveyance position;

wherein the conveyance unit comprises, a first conveyance roller configured to convey the fixation medium, and configured to be in contact with the fixation medium on a surface that is opposite to a surface where the fixing roller contacts with at a position that is downstream of the fixing roller with respect to a conveyance direction of the fixation medium and is upstream of a conveyance position where the conveyance unit conveys the fixation medium; and a plurality of second conveyance rollers disposed along the conveyance direction of the fixation medium, and each disposed to face the first conveyance roller to support and convey the fixation medium; and wherein the guide member is disposed to face the first conveyance roller, and a first (downstream) end portion of the guide member is disposed on a line that passes a contact portion between the first conveyance roller and an upstream side second conveyance roller and a second (upstream) end portion of the guide member, and wherein the fixing member comprises a fixing roller, and wherein the guide member is disposed away by not less than 5 mm downstream along a surface of the fixing roller from a contact portion where the fixing roller contacts the pressuring member, and is disposed so that one end of the guide member is separated from the first conveyance roller with respect to a line connecting a rotation center of the fixing roller and the other end of the guide member which is facing the fixing roller.

35. The thermal fixing device as claimed in claim 34, wherein the pressuring member comprises a plurality of the pressuring members disposed along the conveyance direction of the fixation medium.

36. The thermal fixing device as claimed in claim 35, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

37. The thermal fixing device as claimed in claim 35, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed along a line connecting a rotation center of the fixing roller and one end of the guide member which is facing the fixing roller.

38. The thermal fixing device as claimed in claim 35, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed so that one end of the guide member is separated from the first conveyance roller with respect to a line connecting a rotation center of the fixing roller and the other end of the guide member which is facing the fixing roller.

39. The thermal fixing device as claimed in claim 34, wherein a part of the first conveyance roller is disposed on a line connecting the conveyance position and a contact portion where the fixing member contacts the pressuring member.

40. The thermal fixing device as claimed in claim 34, wherein the guide member is disposed along a direction of a line that intersects with a tangential line of the fixing member at a contact portion where the fixing member contacts the pressuring member.

41. The thermal fixing device as claimed in claim 34, wherein a dynamic friction coefficient of the first conveyance roller at a contact portion where the first conveyance roller contacts the fixation medium is larger than a dynamic friction coefficient of the guide member at a contact portion where the guide member contacts the fixation medium.

42. The thermal fixing device as claimed in claim 34, wherein a contact portion of the first conveyance roller where the first conveyance roller contacts the fixation medium is made of elastic material, and a contact portion of the guide member where the guide member contacts the fixation medium is made of metal material.

43. The thermal fixing device as claimed in claim 34, wherein a part of the first conveyance roller is disposed on a line connecting the conveyance position and a contact portion where the fixing member contacts the pressuring member.

44. The thermal fixing device as claimed in claim 43, wherein the pressuring member comprises a plurality of the pressuring members disposed along the conveyance direction of the fixation medium, and wherein the line connecting the conveyance position and the contact portion corresponds to a line connecting a portion where the pressuring member that is disposed the most downstream contacts the fixing member and a portion where the first conveyance roller contacts to the second conveyance roller that is disposed the most upstream.

45. The thermal fixing device as claimed in claim 44, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

46. A thermal fixing device comprising:

a fixing member disposed to be in contact with a fixation medium;

a pressuring member disposed to face the fixing member and configured to press the fixation medium against the fixing member;

a conveying unit configured to convey the fixation medium that has passed through between the fixing member and the pressuring member; and a guide member configured to guide the fixation medium to the conveyance position;

wherein the conveyance unit comprises, a first conveyance roller configured to convey the fixation medium, and configured to be in contact with the fixation medium on a surface that is opposite to a surface where the fixing roller contacts with at a position that is downstream of the fixing roller with respect to a conveyance direction of the fixation medium and is upstream of a conveyance position where the conveyance umt conveys the fixation medium; and a plurality of second conveyance rollers disposed along the conveyance direction of the fixation medium, and each disposed to face the first conveyance roller to support and convey the fixation medium; and wherein the guide member is disposed to face the first conveyance roller, and a first (downstream) end portion of the guide member is disposed on a line that passes a contact portion between the first conveyance roller and an upstream side second conveyance roller and a second (upstream) end portion of the guide member.

47. The thermal fixing device as claimed in claim 46, wherein the pressuring member comprises a plurality of the pressuring members disposed along the conveyance direction of the fixation medium.

48. The thermal fixing device as claimed in claim 47, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

49. The thermal fixing device as claimed in claim 47, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed along a line connecting a rotation center of the fixing roller and one end of the guide member which is facing the fixing roller.

50. The thermal fixing device as claimed in claim 47, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed so that one end of the guide member is separated from the first conveyance roller with respect to a line connecting a rotation center of the fixing roller and the other end of the guide member which is facing the fixing roller.

51. The thermal fixing device as claimed in claim 46, wherein a part of the first conveyance roller is disposed on a line connecting the conveyance position and a contact portion where the fixing member contacts the pressuring member.

52. The thermal fixing device as claimed in claim 46, wherein the guide member is disposed along a direction of a line that intersects with a tangential line of the fixing member at a contact portion where the fixing member contacts the pressuring member.

53. The thermal fixing device as claimed in claim 46, wherein the fixing member comprises a fixing roller, and wherein the guide member is disposed away by not less than 5 mm downstream along a surface of the fixing roller from a contact portion where the fixing roller contacts the pressuring member, and is disposed along a line connecting a rotation center of the fixing roller and one end of the guide member which is facing the fixing roller.

54. The thermal fixing device as claimed in claim 46, wherein the fixing member comprises a fixing roller, and wherein the guide member is disposed away by not less than 5 mm downstream along a surface of the fixing roller from a contact portion where the fixing roller contacts the pressuring member, and is disposed so that one end of the guide member is separated from the first conveyance roller with respect to a line connecting a rotation center of the fixing roller and the other end of the guide member which is facing the fixing roller.

55. The thermal fixing device as claimed in claim 46, wherein a contact portion of the first conveyance roller where the first conveyance roller contacts the fixation medium is made of elastic material, and a contact portion of the guide member where the guide member contacts the fixation medium is made of metal material.

56. The thermal fixing device as claimed in claim 46, wherein a part of the first conveyance roller is disposed on a line connecting the conveyance position and a contact portion where the fixing member contacts the pressuring member.

57. The thermal fixing device as claimed in claim 56, wherein the pressuring member comprises a plurality of the pressuring members disposed along the conveyance direction of the fixation medium, and wherein the line connecting the conveyance position and the contact portion corresponds to a line connecting a portion where the pressuring member that is disposed the most downstream contacts the fixing member and a portion where the first conveyance roller contacts to the second conveyance roller that is disposed the most upstream.

58. The thermal fixing device as claimed in claim 57, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

59. A thermal fixing device comprising:

a fixing member disposed to be in contact with a fixation medium;

a pressuring member disposed to face the fixing member and configured to press the fixation medium against the fixing member;

a conveying unit configured to convey the fixation medium that has passed through between the fixing member and the pressuring member; and a guide member configured to guide the fixation medium to the conveyance position;

wherein the conveyance unit comprises, a first conveyance roller configured to convey the fixation medium, and configured to be in contact with the fixation medium on a surface that is opposite to a surface where the fixing roller contacts with at a position that is downstream of the fixing roller with respect to a conveyance direction of the fixation medium and is upstream of a conveyance position where the conveyance unit conveys the fixation medium; and a plurality of second conveyance rollers disposed along the conveyance direction of the fixation medium, and each disposed to face the first conveyance roller to support and convey the fixation medium; and wherein the guide member is disposed to face the first conveyance roller, and a first (downstream) end portion of the guide member is disposed on a line that passes a contact portion between the first conveyance roller and an upstream side second conveyance roller and a second (upstream) end portion of the guide member, and wherein a contact portion of the first conveyance roller where the first conveyance roller contacts the fixation medium is made of elastic material, and a contact portion of the guide member where the guide member contacts the fixation medium is made of metal material.

60. An image forming apparatus comprising:

a sheet feeding section configured to feed a sheet; and an image forming section configured to form an image on the sheet fed by the sheet feeding section, wherein the image forming section includes a thermal fixing device comprising:

a fixing member disposed to be in contact with the sheet;

a pressuring member disposed to face the fixing member and configured to press the sheet against the fixing member;

a conveying unit configured to convey the sheet that has passed through between the fixing member and the pressuring member; and a guide member disposed to face the first conveyance roller and configured to guide the sheet to the conveyance position;

wherein the conveyance unit comprises:

a first conveyance roller configured to convey the fixation medium, and configured to be in contact with the fixation medium on a surface that is opposite to a surface where the fixing roller contacts with at a position that is downstream of the fixing roller with respect to a conveyance direction of the fixation medium and is upstream of a conveyance position where the conveyance unit conveys the fixation medium; and a plurality of second conveyance rollers disposed along the conveyance direction of the fixation medium, and each disposed to face the first conveyance roller to support and convey the fixation medium; and wherein the guide member is disposed to face the first conveyance roller, and a first (downstream) end portion of the guide member is disposed on a line that passes a contact portion between the first conveyance roller and an upstream side second conveyance roller and a second (upstream) end portion of the guide member, wherein the fixing member comprises a fixing roller, and wherein the guide member is disposed away by not less than 5 mm downstream along a surface of the fixing roller from a contact portion where the fixing roller contacts the pressuring member, and is disposed along a line connecting a rotation center of the fixing roller and one end of the guide member which is facing the fixing roller.

61. The image forming apparatus as claimed in claim 60, wherein the pressuring member comprises a plurality of the pressuring members disposed along the conveyance direction of the sheet.

62. The image forming apparatus as claimed in claim 61, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

63. The image forming apparatus as claimed in claim 61, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed along a line connecting a rotation center of the fixing roller and one end of the guide member which is facing the fixing roller.

64. The image fonning apparatus as claimed in claim 61, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed so that one end of the guide member is separated from the first conveyance roller with respect to a line connecting a rotation center of the fixing roller and the other end of the guide member which is facing the fixing roller.

65. The image forming apparatus as claimed in claim 60, wherein a part of the first conveyance roller is disposed on a line connecting the conveyance position and a contact portion where the fixing member contacts the pressuring member.

66. The image forming apparatus as claimed in claim 60, wherein the guide member is disposed along a direction of a line that intersects with a tangential line of the fixing member at a contact portion where the fixing member contacts the pressuring member.

67. The image forming apparatus as claimed in claim 60, wherein a dynamic friction coefficient of the first conveyance roller at a contact portion where the first conveyance roller contacts the sheet is larger than a dynamic friction coefficient of the guide member at a contact portion where the guide member contacts the sheet.

68. The image forming apparatus as claimed in claim 60, wherein a contact portion of the first conveyance roller where the first conveyance roller contacts the sheet is made of elastic material, and a contact portion of the guide member where the guide member contacts the sheet is made of metal material.

69. The image forming apparatus as claimed in claim 60, wherein a part of the first conveyance roller is disposed on a line connecting the conveyance position and a contact portion where the fixing member contacts the pressuring member.

70. The image forming apparatus as claimed in claim 69, wherein the pressuring member comprises a plurality of the pressuring members disposed along the conveyance direction of the sheet, and wherein the line connecting the conveyance position and the contact portion corresponds to a line connecting a portion where the pressuring member that is disposed the most downstream contacts the fixing member and a portion where the first conveyance roller contacts to the second conveyance roller that is disposed the most upstream.

71. The image forming apparatus as claimed in claim 70, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

72. An image forming apparatus comprising:

a sheet feeding section configured to feed a sheet; and an image forming section configured to form an image on the sheet fed by the sheet feeding section, wherein the image forming section includes a thermal fixing device comprising:

a fixing member disposed to be in contact with the sheet;

a pressuring member disposed to face the fixing member and configured to press the sheet against the fixing member;

a conveying unit configured to convey the sheet that has passed through between the fixing member and the pressuring member; and a guide member disposed to face the first conveyance roller and configured to guide the sheet to the conveyance position;

wherein the conveyance unit comprises:

a first conveyance roller configured to convey the fixation medium, and configured to be in contact with the fixation medium on a surface that is opposite to a surface where the fixing roller contacts with at a position that is downstream of the fixing roller with respect to a conveyance direction of the fixation medium and is upstream of a conveyance position where the conveyance unit conveys the fixation medium; and a plurality of second conveyance rollers disposed along the conveyance direction of the fixation medium, and each disposed to face the first conveyance roller to support and convey the fixation medium; and wherein the guide member is disposed to face the first conveyance roller, and a first (downstream) end portion of the guide member is disposed on a line that passes a contact portion between the first conveyance roller and an upstream side second conveyance roller and a second (upstream) end portion of the guide member, wherein the fixing member comprises a fixing roller, and wherein the guide member is disposed away by not less than 5 mm downstream along a surface of the fixing roller from a contact portion where the fixing roller contacts the pressuring member, and is disposed so that one end of the guide member is separated from the first conveyance roller with respect to a line connecting a rotation center of the fixing roller and the other end of the guide member which is facing the fixing roller.

73. The image forming apparatus as claimed in claim 72, wherein the fixing member comprises a fixing roller, and wherein the guide member is disposed away by not less than 5 mm downstream along a surface of the fixing roller from a contact portion where the fixing roller contacts the pressuring member, and is disposed so that one end of the guide member is separated from the first conveyance roller with respect to a line connecting a rotation center of the fixing roller and the other end of the guide member which is facing the fixing roller.

74. The image forming apparatus as claimed in claim 73, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

75. The image forming apparatus as claimed in claim 73, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed along a line connecting a rotation center of the fixing roller and one end of the guide member which is facing the fixing roller.

76. The image forming apparatus as claimed in claim 73, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed so that one end of the guide member is separated from the first conveyance roller with respect to a line connecting a rotation center of the fixing roller and the other end of the guide member which is facing the fixing roller.

77. The image forming apparatus as claimed in claim 72, wherein a part of the first conveyance roller is disposed on a line connecting the conveyance position and a contact portion where the fixing member contacts the pressuring member.

78. The image forming apparatus as claimed in claim 72, wherein the guide member is disposed along a direction of a line that intersects with a tangential line of the fixing member at a contact portion where the fixing member contacts the pressuring member.

79. The image forming apparatus as claimed in claim 72, wherein a dynamic friction coefficient of the first conveyance roller at a contact portion where the first conveyance roller contacts the sheet is larger than a dynamic friction coefficient of the guide member at a contact portion where the guide member contacts the sheet.

80. The image forming apparatus as claimed in claim 72, wherein a contact portion of the first conveyance roller where the first conveyance roller contacts the sheet is made of elastic material, and a contact portion of the guide member where the guide member contacts the sheet is made of metal material.

81. The image forming apparatus as claimed in claim 72, wherein a part of the first conveyance roller is disposed on a line connecting the conveyance position and a contact portion where the fixing member contacts the pressuring member.

82. The image forming apparatus as claimed in claim 81, wherein the pressuring member comprises a plurality of the pressuring members disposed along the conveyance direction of the sheet, and wherein the line connecting the conveyance position and the contact portion corresponds to a line connecting a portion where the pressuring member that is disposed the most downstream contacts the fixing member and a portion where the first conveyance roller contacts to the second conveyance roller that is disposed the most upstream.

83. The image forming apparatus as claimed in claim 81, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

84. An image forming apparatus comprising:

a sheet feeding section configured to feed a sheet; and an image forming section configured to form an image on the sheet fed by the sheet feeding section, wherein the image forming section includes a thermal fixing device comprising:

a fixing member disposed to be in contact with the sheet;

a pressuring member disposed to face the fixing member and configured to press the sheet against the fixing member;

a conveying unit configured to convey the sheet that has passed through between the fixing member and the pressuring member; and a guide member disposed to face the first conveyance roller and configured to guide the sheet to the conveyance position;

wherein the conveyance unit comprises:

a first conveyance roller configured to convey the fixation medium, and configured to be in contact with the fixation medium on a surface that is opposite to a surface where the fixing roller contacts with at a position that is downstream of the fixing roller with respect to a conveyance direction of the fixation medium and is upstream of a conveyance position where the conveyance unit conveys the fixation medium; and a plurality of second conveyance rollers disposed along the conveyance direction of the fixation medium, and each disposed to face the first conveyance roller to support and convey the fixation medium; and wherein the guide member is disposed to face the first conveyance roller, and a first (downstream) end portion of the guide member is disposed on a line that passes a contact portion between the first conveyance roller and an upstream side second conveyance roller and a second (upstream) end portion of the guide member, wherein a dynamic friction coefficient of the first conveyance roller at a contact portion where the first conveyance roller contacts the sheet is larger than a dynamic friction coefficient of the guide member at a contact portion where the guide member contacts the sheet.

85. The image forming apparatus as claimed in claim 84, wherein the pressuring member comprises a plurality of the pressuring members disposed along the conveyance direction of the sheet.

86. The image forming apparatus as claimed in claim 85, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

87. The image forming apparatus as claimed in claim 85, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed along a line connecting a rotation center of the fixing roller and one end of the guide member which is facing the fixing roller.

88. The image forming apparatus as claimed in claim 85, wherein the fixing member comprises a fixing roller, and wherein the guide member is disposed away by not less than 5 mm downstream along a surface of the fixing roller from a contact portion where the fixing roller contacts the pressuring member that is disposed the most downstream, and is disposed so that one end of the guide member is separated from the first conveyance roller with respect to a line connecting a rotation center of the fixing roller and the other end of the guide member which is facing the fixing roller.

89. The image forming apparatus as claimed in claim 84, wherein a part of the first conveyance roller is disposed on a line connecting the conveyance position and a contact portion where the fixing member contacts the pressuring member.

90. The image forming apparatus as claimed in claim 84, wherein the guide member is disposed along a direction of a line that intersects with a tangential line of the fixing member at a contact portion where the fixing member contacts the pressuring member.

91. The image forming apparatus as claimed in claim 84, wherein the fixing member comprises a fixing roller, and wherein the guide member is disposed away by not less than 5 mm downstream along a surface of the fixing roller from a contact portion where the fixing roller contacts the pressuring member, and is disposed along a line connecting a rotation center of the fixing roller and one end of the guide member which is facing the fixing roller.

92. The image forming apparatus as claimed in claim 84, wherein the fixing member comprises a fixing roller, and wherein the guide member is disposed away by not less than 5 mm downstream along a surface of the fixing roller from a contact portion where the fixing roller contacts the pressuring member, and is disposed so that one end of the guide member is separated from the first conveyance roller with respect to a line connecting a rotation center of the fixing roller and the other end of the guide member which is facing the fixing roller.

93. The image forming apparatus as claimed in claim 84, wherein a contact portion of the first conveyance roller where the first conveyance roller contacts the sheet is made of elastic material, and a contact portion of the guide member where the guide member contacts the sheet is made of metal material.

94. The image forming apparatus as claimed in claim 84, wherein a part of the first conveyance roller is disposed on a line connecting the conveyance position and a contact portion where the fixing member contacts the pressuring member.

95. The image forming apparatus as claimed in claim 94, wherein the pressuring member comprises a plurality of the pressuring members disposed along the conveyance direction of the sheet, and wherein the line connecting the conveyance position and the contact portion corresponds to a line connecting a portion where the pressuring member that is disposed the most downstream contacts the fixing member and a portion where the first conveyance roller contacts to the second conveyance roller that is disposed the most upstream.

96. The image forming apparatus as claimed in claim 95, wherein the guide member is disposed along a direction of a line that intersects with a tangential line of the fixing member at a contact portion where the fixing member contacts the pressuring member, and wherein the line that intersects with the tangential line corresponds to a line that intersects with a tangential line of the fixing member at a portion where the fixing member contacts the pressuring member that is disposed the most downstream.

97. An image forming apparatus comprising:

a sheet feeding section configured to feed a sheet; and an image forming section configured to form an image on the sheet fed by the sheet feeding section, wherein the image forming section includes a thermal fixing device comprising:

a fixing member disposed to be in contact with the sheet;

a pressuring member disposed to face the fixing member and configured to press the sheet against the fixing member;

a conveying unit configured to convey the sheet that has passed through between the fixing member and the pressuring member; and a guide member disposed to face the first conveyance roller and configured to guide the sheet to the conveyance position;

wherein the conveyance unit comprises:

a first conveyance roller configured to convey the fixation medium, and configured to be in contact with the fixation medium on a surface that is opposite to a surface where the fixing roller contacts with at a position that is downstream of the fixing roller with respect to a conveyance direction of the fixation medium and is upstream of a conveyance position where the conveyance unit conveys the fixation medium; and a plurality of second conveyance rollers disposed along the conveyance direction of the fixation medium, and each disposed to face the first conveyance roller to support and convey the fixation medium; and wherein the guide member is disposed to face the first conveyance roller, and a first (downstream) end portion of the guide member is disposed on a line that passes a contact portion between the first conveyance roller and an upstream side second conveyance roller and a second (upstream) end portion of the guide member, wherein a contact portion of the first conveyance roller where the first conveyance roller contacts the sheet is made of elastic material, and a contact portion of the guide member where the guide member contacts the sheet is made of metal material.

* * * * *